US006148654A

United States Patent [19]

Jensen et al.

[11] Patent Number: 6,148,654

[45] Date of Patent: Nov. 21, 2000

[54] CONVERTIBLE ROLL FORMING APPARATUS

[75] Inventors: Gary L. Jensen, Liberty Lake; Robert G. McLellan, Spokane; Terrance L. Jud, Cheney, all of Wash.

[73] Assignee: ASC Machine Tools, Inc., Spokane, Wash.

[21] Appl. No.: 09/173,150

[22] Filed: Oct. 14, 1998

Related U.S. Application Data

[60] Provisional application No. 60/062,379, Oct. 15, 1997.

[51] Int. Cl.[7] ..... B21D 5/08

[52] U.S. Cl. ..... 72/181; 72/178

[58] Field of Search ..... 72/181, 178, 182, 72/176

[56] References Cited

U.S. PATENT DOCUMENTS

| | | | |
|---|---|---|---|
| 3,462,989 | 8/1969 | Fischer | 72/178 |
| 4,557,129 | 12/1985 | Lash et al. | 72/176 |
| 4,716,754 | 1/1988 | Youngs | 72/178 |
| 4,787,232 | 11/1988 | Hayes | 72/176 |
| 5,163,311 | 11/1992 | McClain et al. | 72/181 |
| 5,187,964 | 2/1993 | Levy | 72/181 |
| 5,761,945 | 6/1998 | Vandenbroucke | 72/176 |

FOREIGN PATENT DOCUMENTS

| | | | |
|---|---|---|---|
| 749721 | 12/1944 | Germany | 72/178 |
| 151121 | 11/1981 | Japan | 72/181 |
| 181428 | 10/1983 | Japan | 72/181 |
| 2141954 | 1/1985 | United Kingdom | 72/181 |
| 2153720 | 8/1985 | United Kingdom | 72/181 |

*Primary Examiner*—Daniel C. Crane
*Attorney, Agent, or Firm*—Crowe & Dunlevy

[57] ABSTRACT

A convertible roll forming apparatus for forming flanges on a strip of material in which a roller assembly is supported on a support stand and disposed to move the strip material in a material feed direction. A pivotal support assembly supports a knuckle member for pressing against an edge portion of the strip material, the knuckle member cooperating with the support assemblies to progressively form the edge portion into a flange. The support assembly can be selectively disposed to form the edge portion in a first direction or in an opposing second direction. The strip material can be passed through serial passes of support assemblies and knuckle members to progressively form the flange. The roller assembly is supported for lateral expansion to accommodate various widths of strip material as required, and a lip forming section is provided to form a lip on the outer edge of the formed flange. Flange straightener assemblies are also provided to control the overbend.

23 Claims, 27 Drawing Sheets

CONVERTIBLE ROLL FORMING APPARATUS

RELATED APPLICATIONS

This application claims the benefit of U.S. Provisional Application No. 60/062,379 filed Oct. 15, 1997, hereby incorporated by reference.

FIELD OF THE INVENTION

The present invention relates generally to the field of sheet metal fabrication, and more particularly but not by way of limitation, to a convertible roll forming apparatus.

BACKGROUND OF THE INVENTION

Roll forming is a widely practiced method of material forming that can be particularly advantageous when producing parts that are formed into a sectional profile characteristic from an extended length of a strip of material, usually thin sheet metal. Forming the bends that make up the characteristic profile on a press brake one at a time is an alternative approach, but is an alternative wrought with the penalty of a significantly longer cycle time per part. The primary disadvantage of roll forming, however, has been the inflexibility associated with not being able to run more than one part with a given tooling set up, and the relatively long change over time between part runs. For this reason, roll forming has in the past been justifiable primarily for complex parts produced at high volumes.

Advances in roll forming machines have generally lessened the otherwise inherent inflexibility of roll forming approaches. Methods of quickly changing the roll forming tooling have been advanced in recognition of the lengthy delays associated with breaking down a setup and reconfiguring it. Typical of these advances include the use of a turret to store a number of forming tools and deliver the desired tool to an operable position, such as according to the teaching of U.S. Pat. No. 4,557,129 issued to Lash et al. Microprocessor-driven systems have been applied to the process to provide quick, automated tool changes, such as in accordance with the teaching of U.S. Pat. No. 5,761,945 issued to Vandenbroucke. Other approaches recognize the value of variable tooling, such as the variable flange width capability according to the teaching of U.S. Pat. No. 5,163,311 issued to McClain et al. Still other known approaches utilize more than one roll forming line sharing a common drive train mechanism.

In some applications the ability to use the same roll forming tooling but at various laterally spacings has been recognized as an advancement in the art. Approaches providing a variable width part, such as according to U.S. Pat. No. 5,187,964 issued to Levy, are particularly well suited to the production of families of parts that have common formed edges separated by a variable medial web. An example is in the production of metal truss components used in the construction industry, where cee purlins and zee purlins are commonly used having various heights as determined by the width of the web.

Further advancement yet was made by making the roll forming tooling convertible, that is, capable of being adjustable so that the flange provided by the tooling can be positioned in a first mode to form the flange generally upwardly, and can furthermore be positioned in a second position whereby the flange is formed generally downwardly. An approach providing such an advancement was recognized in U.S. Pat. No. 4,787,232 issued to Hayes, which teaches a roll forming member that is convertibly adjustable so as to enable the production of either cee or zee purlins.

As the art continues to evolve, advances will be recognized that further simplify and enhance the process of making families of parts on a common tooling arrangement in a roll forming machine. One opportunity for improvement lies in an ability to standardize the roll forming tooling among the sequential passes providing the progressive forming. Hayes and other related teachings rely on the approach of using dedicated tooling to form the associated incrementally formed flange.

For example, a simple ninety-degree angle is commonly formed in a number of passes, each of which urges the flange incrementally toward the ultimate ninety degree angle. In forming a quality bend the amount of bending per pass is obviously limited. In forming the ninety degree angle a typical approach would be to do so in six passes of approximately 15 degrees in each pass. The roll forming tooling of the prior art thereby consists of six different sets of rollers, typically a matching male and female roller, that contain the roll forming edges which incrementally form the flange. It would be advantageous, in terms of reduced complexity and expense, to provide for all the passes to utilize common roll forming tooling and incorporate the incremental forming in another manner, such as the manner in which the tooling is supported.

Another opportunity for improvement lies in providing the ability to form materials having coatings that cannot be disrupted by the forming process. Galvanized steel, for instance, is susceptible to premature corrosion when the base metal is exposed from marring or cracking of the zinc coating. Prepainted steel is another example of coated material not well suited for roll forming in the current state of the art.

The reason that coated materials are not well suited to roll forming lies in the nature of conventional roll former tooling approaches, wherein a female roller is pressingly engaged by a male roller, both defining the desired profile of the part after passing thereby. This arrangement inevitably provides a roller-to-part engagement with varying roller velocities across the formed portion of the part. This results in a wiping action between the roller and the part, which is likely to damage the coating on a coated part.

It would be advantageous to provide a roller to part engagement interface such that the velocity of the roller contact surface is constant across the formed portion, thereby preventing surface damage to the part during forming.

There is a need in the industry for an advancement in the art that would satisfy these and other related requirements, making the roll forming approach viable in a broader scope of uses as a simpler and less expensive alternative in comparison to other well known metal forming approaches.

SUMMARY OF THE INVENTION

The present invention provides a convertible roll forming apparatus for forming flanges on a strip of material, such as into the shape of zee or cee purlins or the like. A roller assembly is supported on a support stand to grip and move the strip material in a material feed direction. A pivotal support assembly supports a knuckle member for pressing against an edge portion of the strip material, the knuckle member cooperating with the roller assembly to form the edge portion into a flange. The support assembly can be selectively pivoted to dispose the knuckle member against a selected side of the strip material to form the edge portion in a first direction or in an opposing second direction.

The strip material can be serially passed through multiple roller assemblies and pivotal support assemblies having knuckle members to progressively forming the flange. The roller assemblies are supported for lateral expansion to accommodate various widths of strip material as required, and a lip forming section is provided to form a lip on the outer edge of the formed flange.

An object of the present invention is to provide a flange forming apparatus that forms a flange on strip material independently of a driving apparatus that moves the strip material along the feed direction as the flange is formed.

An object of the present invention is to provide a roll forming apparatus capable of selectively forming flanges and the like in selected directions.

Another object of the present invention, while achieving the above stated object, is to provide a flange forming apparatus that is capable of forming both zee purlins or cee purlins, or the like.

One other object of the present invention, while achieving the above stated objects, is to provide a flange forming apparatus that is capable of operator selection of forming either zee or cee flange patterns with a minimum of setup time.

Yet another object of the present invention, while achieving the above stated objects, is to provide a roll forming apparatus that is economical to manufacture and affords ease of operation, maintenance and setup.

Other objects, advantages and features of the present invention will be apparent from the following description when read in conjunction with the drawings and appended claims.

DETAILED DESCRIPTION

Figure 1:
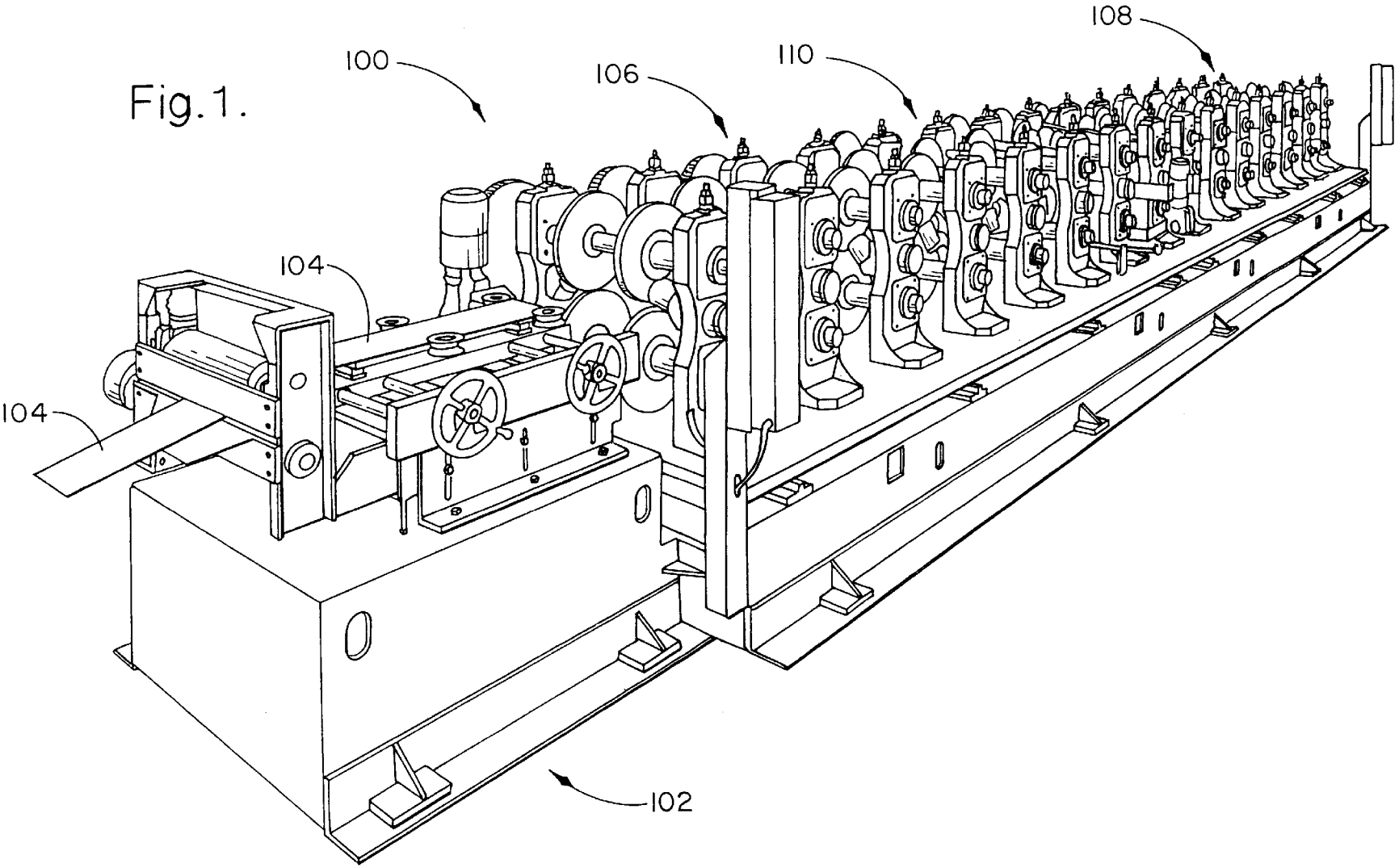
FIG. 1 is a perspective view of a convertible roll forming apparatus constructed in accordance with the present invention.

Referring to the drawings in general and particular to FIG. 1, shown therein is a convertible roll forming apparatus 100 constructed in accordance with the present invention. It will be understood that numerous details of construction beyond that which will be described will be clear to those skilled in the art and need not be provided herein. Identical numerals designating the same or like components will be used throughout the drawings except as may otherwise be noted.

A strip feeder assembly 102 delivers a piece of strip material 104 to the first of several roller passes of the convertible roll forming apparatus 100. The work performed by the convertible roll forming apparatus 100 is to form the strip material 104, which is typically within the range of 10 to 16 gauge sheet steel material having a length typically from between about 6 feet long up to about 40 feet long, into a purlin member having either a zee or cee cross sectional shape.

At a proximal end 106 of the convertible roll forming apparatus 100 the strip material 104 is acted on by a set of progressively forming knuckle idlers.

At a distal end 108 of the convertible roll forming apparatus 100 the strip material 104 is acted on by a set of stiffening lip forming assemblies. At a medial portion 110 of the convertible roll forming apparatus 100 the strip material 104 is acted on by a set of flange straightening assemblies before the stiffening lips are formed.

Figure 2:
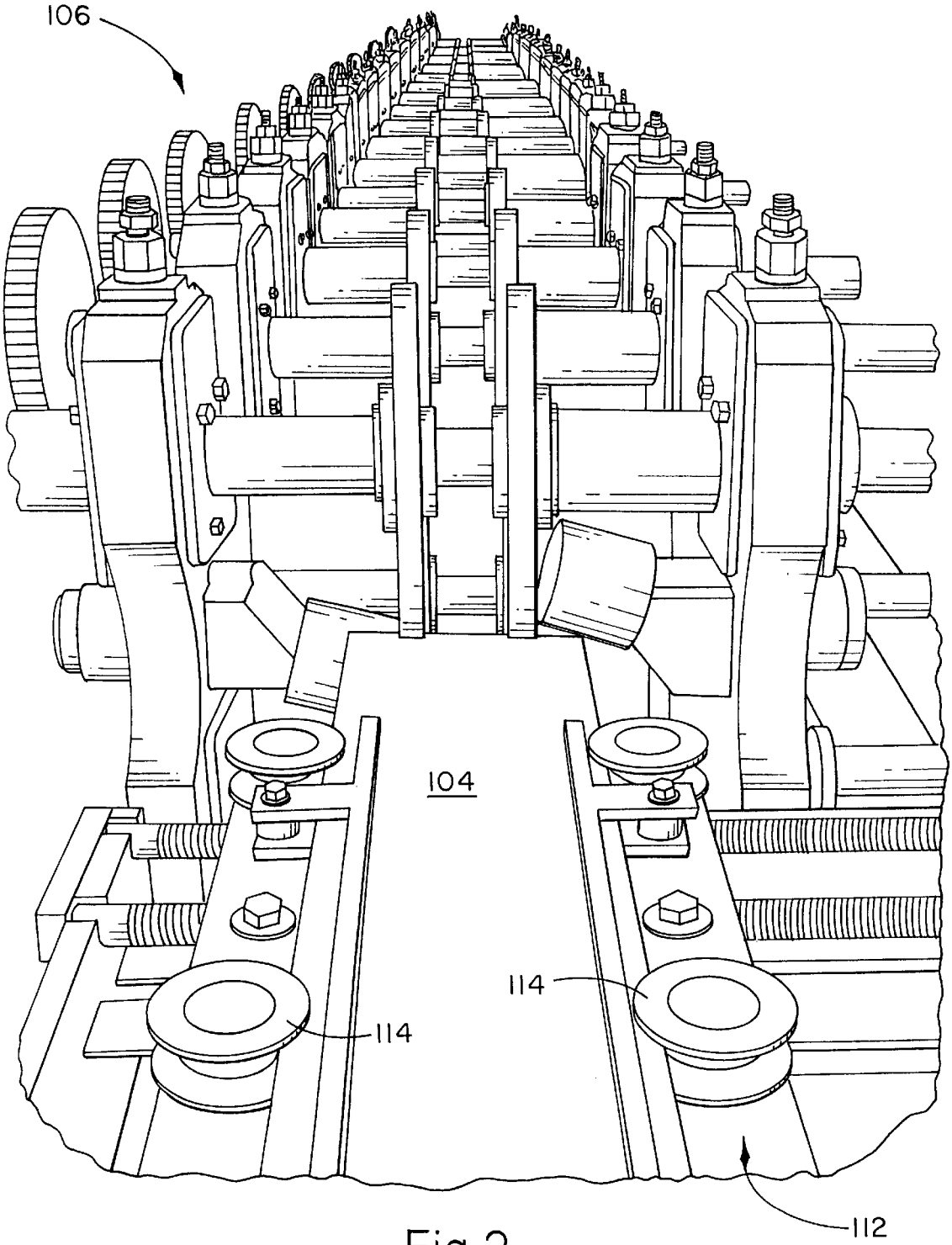
FIG. 2 is a perspective view of the proximal end of the roll forming apparatus of FIG. 1 showing a strip of material being fed thereto.
Figure 3:
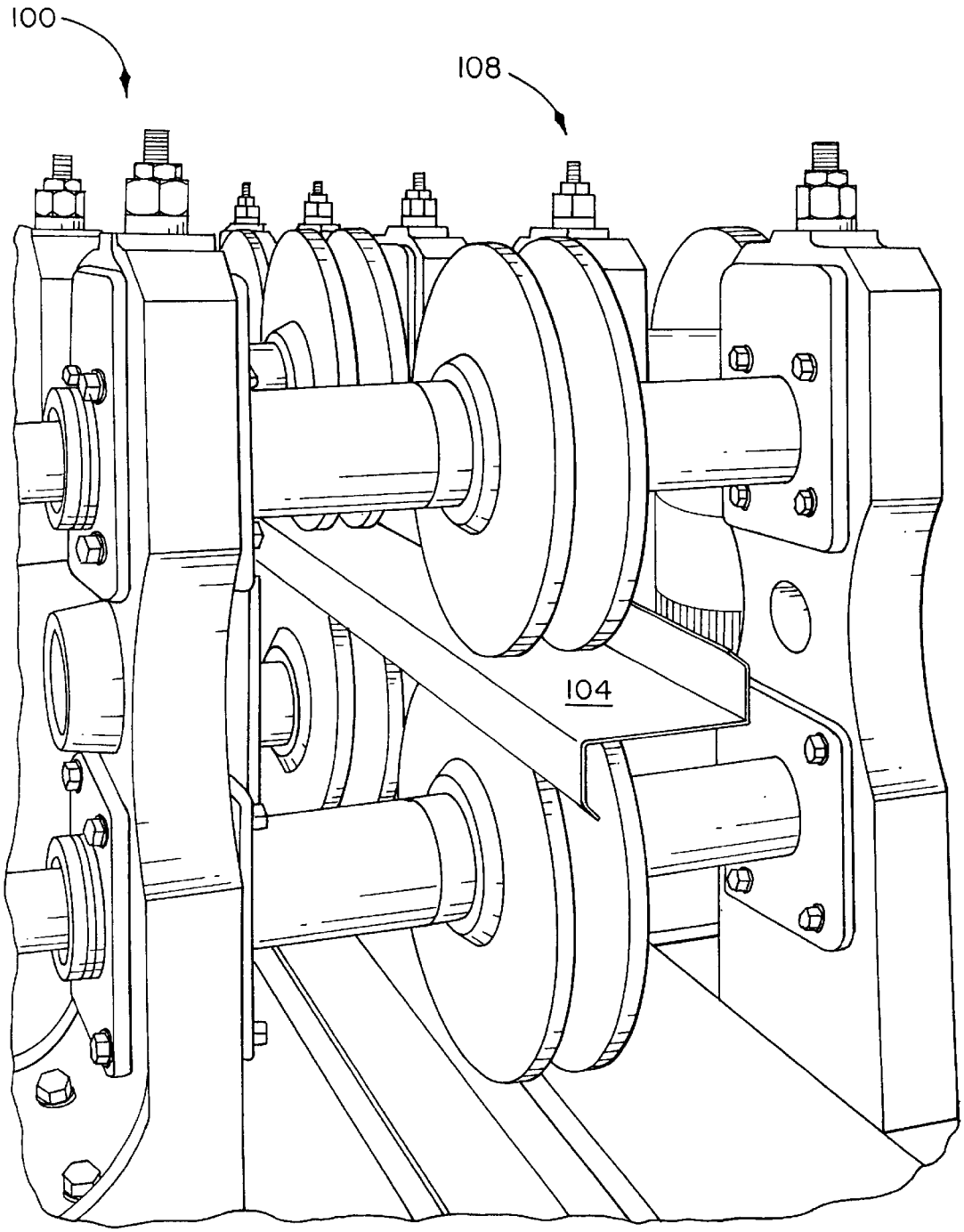
FIG. 3 is a perspective view of the distal end of the roll forming apparatus of FIG. 1 showing the strip material exiting in the shape of a zee purlin.

FIG. 2 shows the strip material 104 entering the convertible roll forming apparatus 100 at its proximal end 106 guided by a laterally adjustable support table assembly 112 having a number of crowder rollers 114 rollingly engaging the strip material 104 edgewise. The support table assembly portions the strip material 104 relative to one side of rollers to form a flange, and the width of the strip material and portion of the opposing rollers determines the size of the opposing flange. FIG. 3 shows the strip material 104 exiting the distal end 108 of the convertible roll forming apparatus 100 after having been formed into a zee shaped purlin with stiffening lips.

Figure 4:
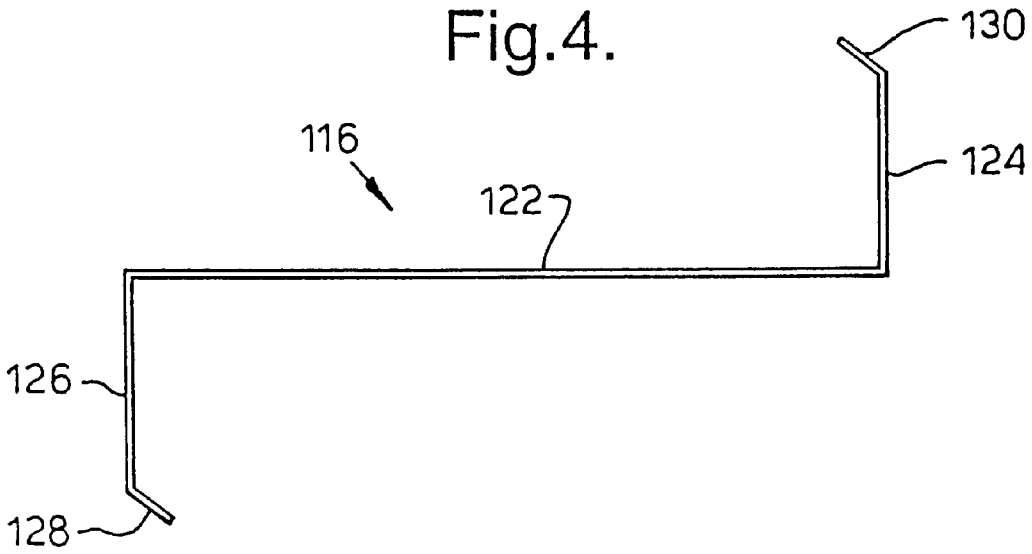
FIG. 4 is an end view of a typical zee purlin with lip portions formed at the distal ends of the flanges.
Figure 5:
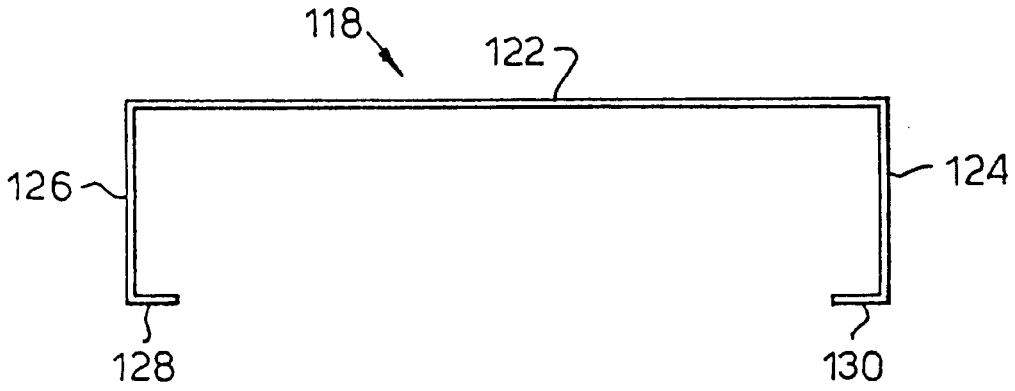
FIG. 5 is an end view of a typical cee purlin with lip portions formed at the distal ends of the flanges.
Figure 6:
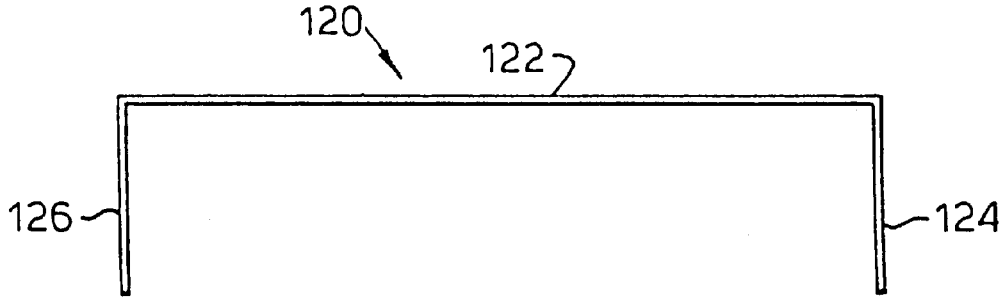
FIG. 6 is an end view of a typical cee purlin without lip portions; sometimes referred to as a cee channel.

The convertible roll forming apparatus 100 of FIG. 1 is particularly suited for roll forming families of different formed parts from sheet material with a common tooling setup. Different parts can be formed after an automatic adjustment to the manner in which the roll forming assemblies support the roll forming tooling. One example that typifies the advantages offered by the present invention is the ability to form different sheet metal components that are used in the construction of wall and roof structures. FIGS. 4, 5 and 6 illustrate the cross sections of an exemplary family of parts: a zee shaped purlin 116 in FIG. 4; a cee shaped purlin 118 in FIG. 5; and a cee shaped purlin or channel member 120 in FIG. 6.

The zee purlin 116 has a web 122, two flange sections 124, 126 and two lip sections 128, 130. Similarly, the cee purlin 118 has a web 122, flange sections 124, 126 and lip sections 128, 130. A variation of the cee purlin 118 is the cee channel 120 of FIG. 6 which has a web 122 and flange sections 124, 126, but the cee channel 120 has no lip sections. The following discussion is limited to the production of these three different parts with common tooling setup, but the present invention is not limited to the production of these exemplary parts as such do not constitute an exhaustive representation of the forming capabilities of the present invention. Other part families can be produced in the manner described below and are within the spirit and scope of the present invention as described and claimed herein.

Figure 7:
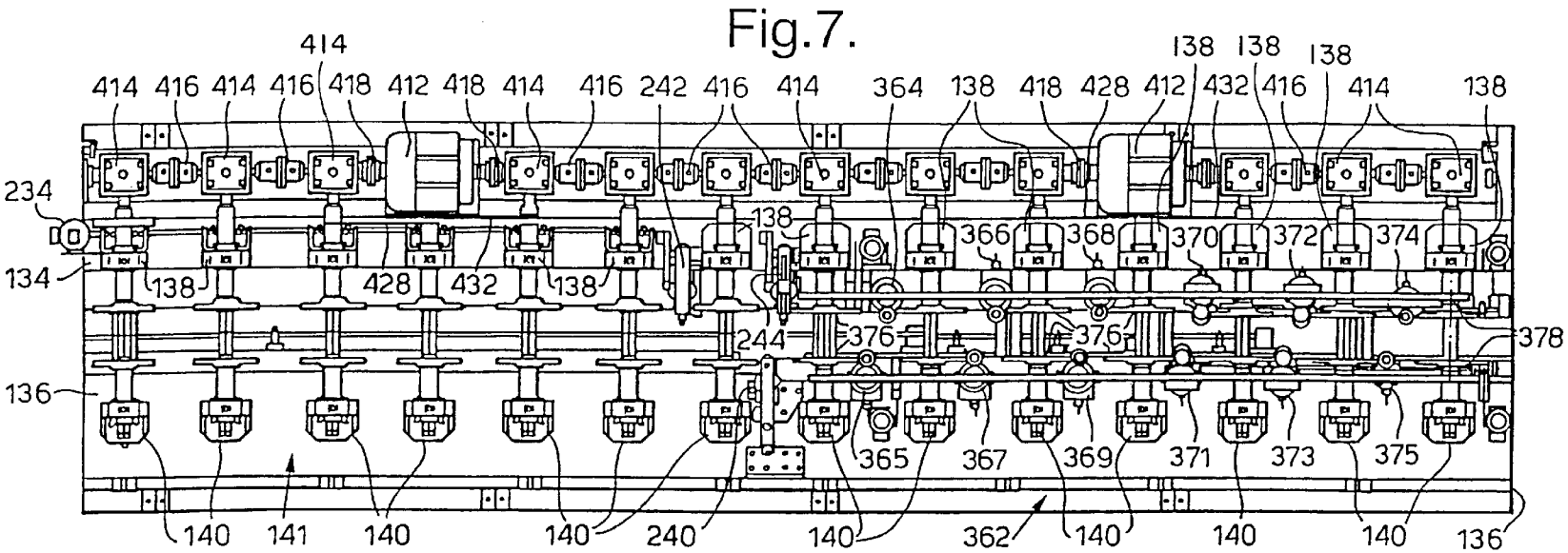
FIG. 7 is a plan view of the roll forming apparatus of FIG. 1.
Figure 8:
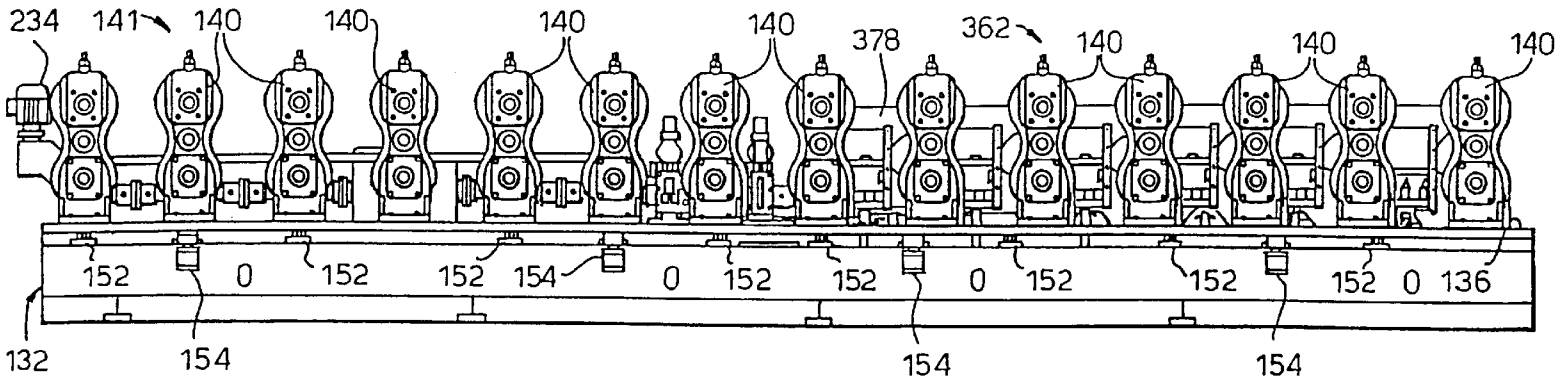
FIG. 8 is an elevational view of a portion of the roll forming apparatus of FIG. 1.

FIGS. 7 and 8 are plan and elevational views, respectively, of the convertible roll forming apparatus of FIG. 1. A table mounted structural mill base 132 supports a fixed base plate 134 and a laterally moveable base plate 136. The base plates 134, 136 support a plurality of inboard support stands 138 and outboard support stands 140, respectively. As will be made clear in the following discussion, the first seven passes, that is, the first seven pairs of support stands 138, 140 form a flange forming section 141 and support flange forming tooling. The last seven passes are lip forming tooling interposed between adjacent drive rollers.

Figure 9:
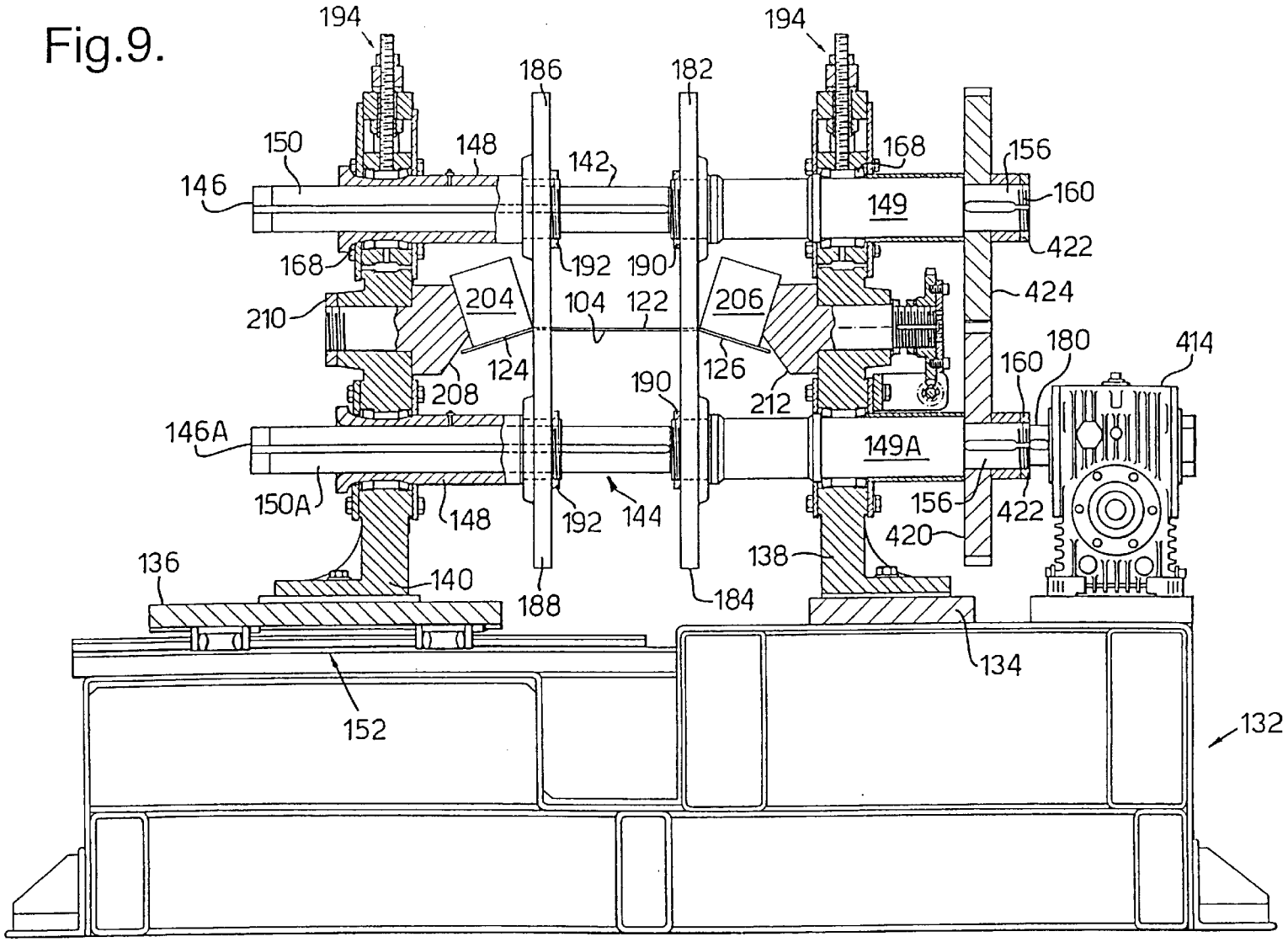
FIG. 9 is a partial sectional view in elevation of the first pass of the roll forming apparatus of FIG. 1.

FIG. 9 is a partial sectional view of the first pass showing the manner in which the first inboard support stand 138 and first outboard support stand 140 cooperatively support an upper roller assembly 142 and a lower roller assembly 144. The roller assembly 142 has an upper shaft 146 and a first sleeve 148. The shaft 146 is journalled for rotation at a proximal portion 149 in the inboard support stand 138. The sleeve 148 is slidably fitted over a distal portion 150 of the shaft 146, the sleeve 148 being journalled for rotation in the outboard support stand 140.

The roller assembly 144 similarly has a lower shaft 146A and a second sleeve 148. The shaft 146A is journalled for rotation at a proximal portion 149A in the inboard support stand 138. The sleeve 148 is slidably fitted over a distal portion 150A of the shaft 146A, the sleeve 148 being journalled for rotation in the outboard support stand 140.

It will be noted the inboard support stand 138 is supported by the fixed base plate 134 and the outboard support stand 140 is supported on the moveable base plate 136. The moveable base plate 136 is supported for lateral movement on a number of linear bearings 152 and is moved by a number of machine screw actuators 154 (see FIG. 8) in a common manner.

Figure 10:
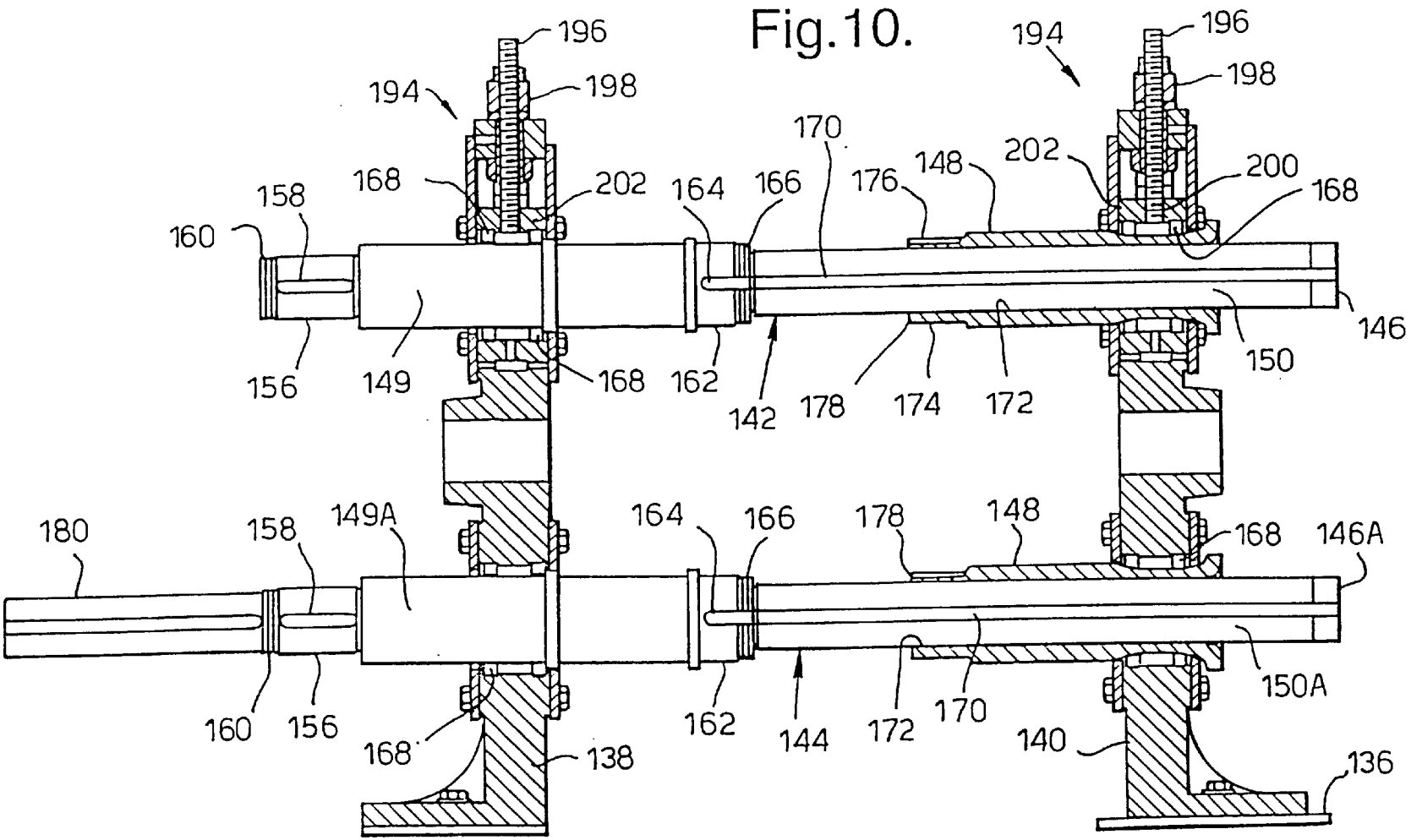
FIG. 10 is a partial sectional view similar to FIG. 9 but having the roll forming tooling removed.

FIG. 10 shows the upper and lower shafts 146, 146A of the roller assemblies 142, 144 supported by the support stands 138, 140 with all roll forming tooling omitted for clarity of illustration. The upper shaft 146 has a gear receiving extension with a keyway 158 and a threaded portion 160. A roller receiving portion 162 with a keyway 164 and a threaded portion 166 are disposed at a first medial position on the shaft 146 adjacent the proximal end portion 149 of the shaft 146. The lower shaft 146A also has a gear receiving extension 156 with a keyway 158 and a threaded portion 160. A roller receiving portion 162 with a keyway 164 and a threaded portion 166 are disposed at a first medial position on the shaft 146A adjacent the proximal end portion 149A of the shaft 146A.

The outboard support stand 140 moves laterally on the moveable base plate 136 (FIG. 9) to permit quick and simple adjustment in the tooling setup for handling different widths of strip material 104. In compensating for this lateral movement of the outboard support stand 140 the upper and lower shaft assemblies 142, 144 are thereby made adjustable in the length with which they span the support stands 138, 140. To this end it will be noted the upper and lower shafts 146, 146A are journalled for rotation in the inboard support stand 138 by suitable roller bearings 168 such that the lateral position of the shafts 146, 146A are fixed relative to the inboard support stand 138. The upper and lower sleeves 148 are likewise journalled for rotation by roller bearings 168, such that the lateral position of the sleeves 148 are fixed relative to the outboard support stand 140.

In providing lateral movement to the outboard support stand 140, the distal portions 150, 150A of the upper and lower shafts 146, 146A have keyways 170 that receivingly support keys (not shown). Keyways (not shown) in the sleeves 148 are aligned with the keyways 170 so that the sleeves 148 are keyed for rotation with the shafts 146, 146A.

The keyways 170 can be sized to provide a sliding fit with the keys while the keyways in the sleeves 148 provide a press fit with the keys. Additionally, the sleeves 148 have appropriately dimensioned inner surfaces 172 that cooperate with the outer diameters of the distal portions 150, 150A to provide sliding engagement therebetween. In this manner the sleeves 148 are keyed to the distal portions 150, 150A for fixed rotation and moveable lateral position relative to the upper and lower shafts 146, 146A.

Each of the upper and lower sleeves 148 has a roller receiving portion 174 with a keyway 176 and a threaded portion 178. Additionally, the shaft 146A of the lower roller assembly 144 forms a gear receiving extension 180. As discussed in the following, the extension 180 engages a drive assembly for rotating the roller assemblies 142, 144.

Returning now to FIG. 9 wherein it is understandable the manner in which an inboard pair of tooling rollers 182, 184 and an outboard pair of tooling rollers 186, 188 are supported by the roller assemblies 142, 144. The inboard tooling rollers 182, 184 have keyed bores appropriately sized for disposition on the roller receiving portions 162 (FIG. 10) of the shafts 146 and 146A, and are keyed to the shafts 146 and 146A and locked in place by tooling lock nuts 190 that threadingly engage the threaded portions 166 (FIG. 10). The outboard tooling rollers 186, 188 have keyed bores appropriately sized for disposition on the roller receiving portions 174 (FIG. 10) of the sleeves 148, and are keyed to the sleeves 148 and locked in place by tooling lock nuts 192.

It will be recognized that for a given rotation of the shafts 146, 146A, the threading engagement of the threaded portions 166, 178 (FIG. 10) and mating tooling lock nuts 190, 192 are necessarily opposite with respect to each other. That is, in order to prevent the rollers 182, 184 from imparting rotational forces that loosen the tooling nuts 190, 192, the threaded portion 166 (FIG. 10) and tooling nut 190 can be provided with right-handed threads while the threaded portion 178 and tooling nut 192 can be provided with left-handed threads.

The pair of rollers 182, 184 and the pair of rollers 186, 188 are driven in opposite rotational directions, as described below, to grip and drive the strip material 104 in a feed direction, flowing from the proximal end 106 toward the distal end 108 of the convertible roll forming apparatus 100. The clearance between contacting faces of each pair of tooling rollers 182, 184 and 186, 188 is determined by an adjustable yoke assembly 194 provided at the top of each of the support stands 138, 140. It is advantageous to adjust the clearance in order to provide an appropriate gripping force, and to provide for various thicknesses of strip material to be formed.

Referring once again to FIG. 10, each adjustable yoke assembly 194 has a threaded shaft member 196 that is lockable at a selected position by a threaded sleeve 198. Preferably, the threaded sleeve 198 is graduated in accordance with a pitch diameter of the threaded shaft member 196 so as to provide a visual reading of the advancement of a distal end 200 which is attached to a yoke 202 that, in turn, supports the bearings 168.

The present invention provides a novel approach to forming the strip material 104 into the desired shape, such as for example into the shape of the cee purlin 118 (FIG. 5), which will be described starting with reference to FIG. 9. As shown therein, the convertible roll forming apparatus 100 has a common set of tooling provided by opposing knuckle idlers supported by the support stands 138, 140. That is, a fixed knuckle idler 204 and a convertible knuckle idler 206 act in conjunction with the pair of tooling rollers 186, 188 and the pair of tooling rollers 182, 184, respectively, to urge the outer edge portions of the strip material 104 (the flange portions 124, 126 that are bent to form the cee purlin 118) against the bending radius provided by the radiused edges of the tooling rollers 186, 188 and the tooling rollers 182, 184 as shown. The radiused tooling rollers 182, 184, 186 and 188 thus support the strip material 104 which flows through a bend radius about the tooling radius in forming the flanges 124, 126.

The knuckle idlers 204, 206 and tooling rollers 186, 188 and 182, 184, respectively, thereby induce bending in the strip material 104 at a bend radius that originates next to the outer surface of the tooling rollers 182, 184, and 186, 188. It has been determined advantageous to provide a minimal tooling offset that incrementally moves the tooling rollers 182, 184 and 186, 188 toward each other in downstream passes as compared to upstream passes. In this manner, the bend radius can continually shift so that subsequent passes do not bend about the same radius as a previous pass, which is known to create problems associated with work hardening of the strip material 104. The incremental indexing can be provided as needed for material characteristics at hand, and generally an incremental index of ten to thirty mills per pass is a sufficient index.

It will be recognized that there is an inherent advantage associated with all of the rollers 182, 184 and 186, 188 contacting the strip material with a constant surface velocity. For example, the flange 126 is formed by the tooling rollers 182, 184 grippingly supporting opposing sides of the strip material 104 while the knuckle idler 206 forms the flange 126 with a forming surface parallel to the desired bend angle. Thus, there is no wiping action between a roller and the strip material 104 during this forming action. This prevents surface damage to the strip material 104 and makes the convertible roll forming apparatus 100 of the present invention particularly suited for surface-sensitive applications, such as in the case of roll forming pre-painted sheet material.

Continuing with reference to FIG. 9, the fixed knuckle idler 204 is journalled to a knuckle 208 which, in turn, is supported by the outboard support stand 140 and attached thereto by a locking nut 210. It will be noted that the position of the knuckle 208, and hence the knuckle idler 204 relative to the tooling rollers 186, 188, is fixed. As such, for all types of purlin shapes, the flange 124 formed on the outboard side of the strip material will be formed in the same direction, such as a downward direction relative to the horizontal web 122 of the strip material 104 as shown in FIG. 9.

Figure 11:
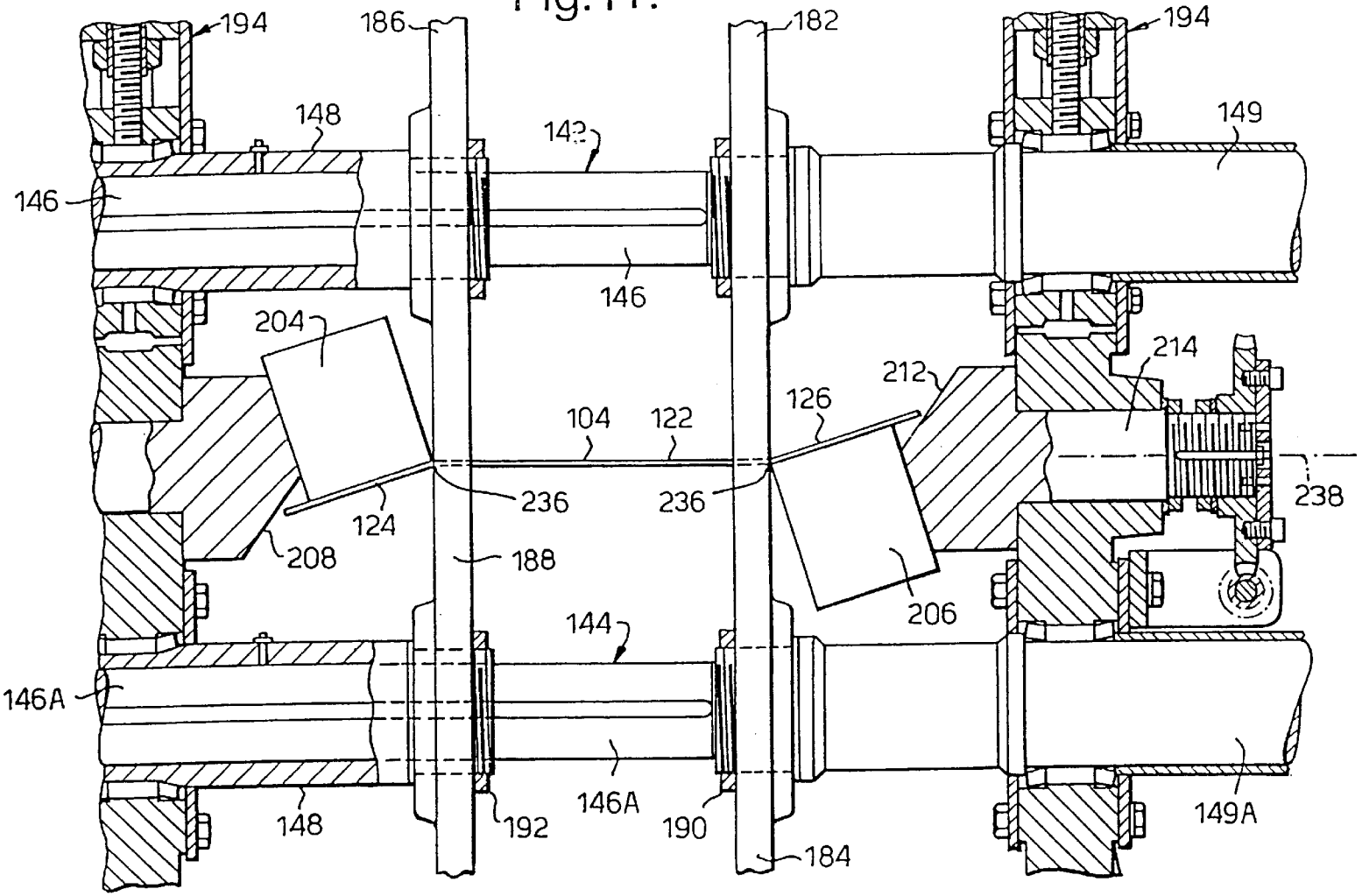
FIG. 11 is a partial sectional view similar to FIG. 9 showing the knuckle idlers engaging opposing sides of the strip material.

The convertible knuckle idler 206 is journalled to a knuckle 212 that is pivotally supported by the inboard support stand 138. As shown in FIG. 9, the flange 126 formed against the convertible knuckle idler 206 is formed downwardly. Conversely, as will be discussed below with reference to FIG. 11, the convertible knuckle idler 206 can be rotated so that the flange 126 is formed upwardly. It will be recognized that the arrangement of the knuckle idler 206 will determine whether the flange 126 is formed downwardly (FIG. 9) or upwardly (FIG. 11). That is, the rotational position of the knuckle idler 206 as shown in FIG. 9 forms a cee purlin 118 or a cee channel 120; whereas the rotational position of the knuckle idler 206 as shown in FIG. 11 forms a zee purlin 116.

It will be understood that the previous discussion is illustrative only and not an exhaustive listing of the knuckle idler 204, 206 arrangements contemplated by the present invention. In an alternative embodiment the outboard knuckle idler could be arranged to always provide an upward flange. Alternatively, in yet another embodiment both inboard and outboard knuckle idlers could be convertible so as to each provide either upward or downward projecting flanges.

Figure 12:
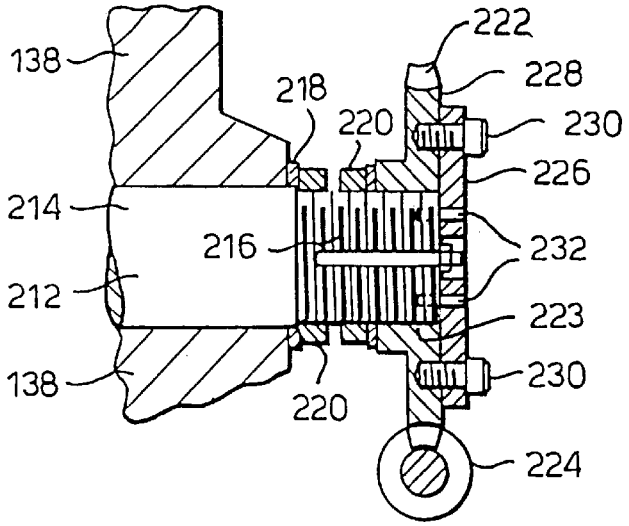
FIG. 12 is a detail view of a portion of the shaft support of the knuckle idlers of the roll forming apparatus of FIG. 1.

FIG. 12 shows a portion of the knuckle 212 which supports the convertible knuckle idler 206. A cylindrical tail portion 214 of the knuckle 212 terminates in a threaded portion 216, and a thrust bearing 218 is interposed between a locking nut 220 and the inboard support stand 138 to rotatingly support the knuckle 212 and convertible knuckle idler 206. A worm gear 222 has a threaded hub 223 for threadingly engaging the threaded portion 216. The worm gear 222 is threadingly engaged by a worm shaft 224 that rotatingly imparts rotation to the worm gear 222 to provide the operational positioning of the convertible knuckle idler 206 to form either an upward or downward flange 126 as desired.

The above described construction provides a simple method of timing the worm gear 222 relative to the pitch of the worm shaft 224 so as to provide a positive threading engagement therebetween. The worm gear 222 can be threadingly advanced on the threaded portion 216 an amount necessary to offset a selected amount of slack between the mating threads of the worm gear 222 and the worm shaft 224. Thereafter, the worm gear 222 can be temporarily locked in the desired position by tightening the locking nut 220. For a permanent attachment, a worm gear lock bar 226 is rigidly attached to a face 228 of the worm gear 222 by a number of threaded fasteners 230. The worm gear lock bar 226 is then rigidly secured to the threaded portion 216, such as by drilling appropriately sized holes through the worm gear lock bar 226 and into an end of the threaded portion 216, and then press fitting a number of compression pins 232 to provide a locking retention therebetween.

This described method of timing the worm gear 222 and the worm shaft 224 is particularly advantageous considering the fact that the first six passes in the convertible roll forming apparatus 100 incorporate the use of convertible knuckle idlers 206 with corresponding worm gears 222, and all six worm gears 222 are simultaneously rotated by the rotation of the worm shaft 224 to pivot the convertible knuckle idlers 206. As discussed below, the seventh pass is a special case that does not require a convertible knuckle.

Figure 13:
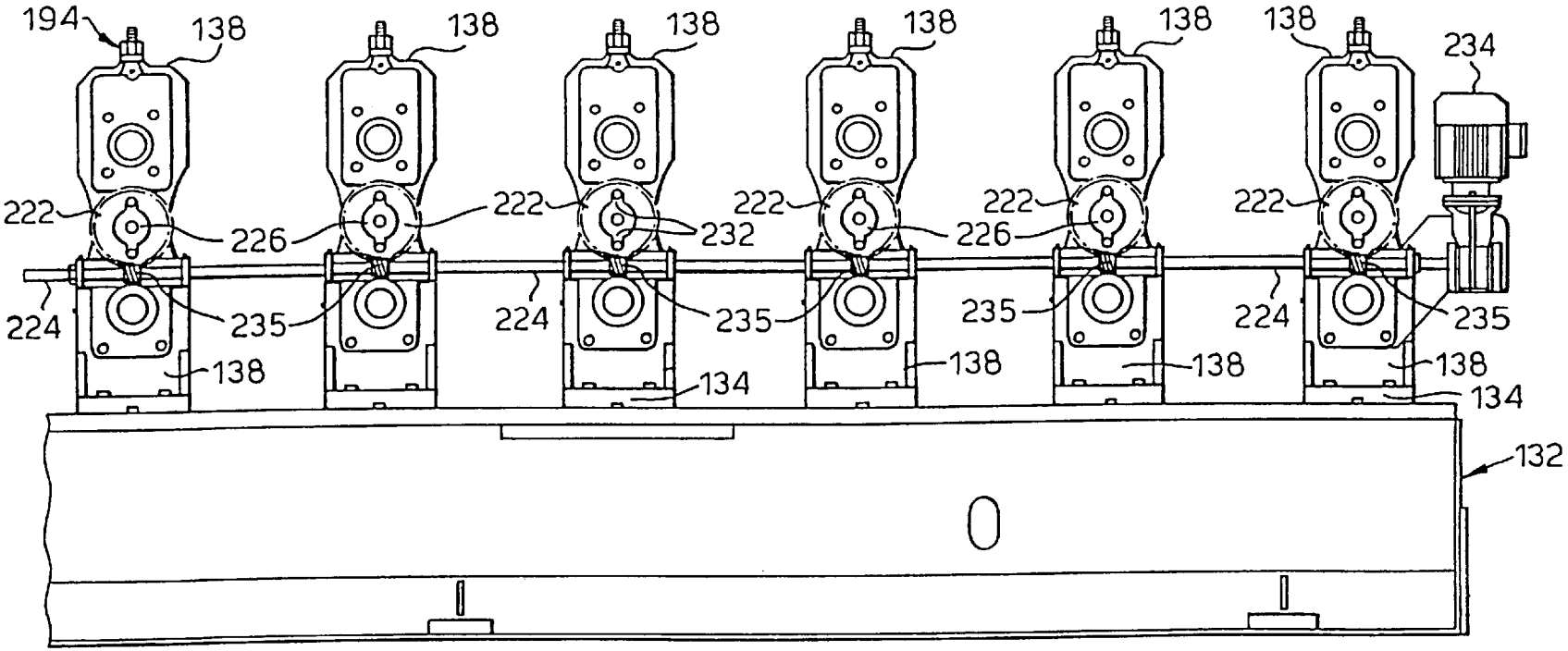
FIG. 13 is an elevational view of a portion of the roll forming apparatus of FIG. 1 showing the worm shaft that serves to arrange the pivotal knuckle idlers.

FIG. 13 best shows the worm shaft 224 which is connected to a gearmotor 234. It will be recognized the worm shaft 224 has a number of worm portions 235 for simultaneous engagement with the six worm gears 222, each of which, in turn, pivots the respective convertible knuckle idler 206 to the downward flange 126 forming position (FIG. 9) or to the upward flange 126 forming position (FIG. 11).

Preferably, the worm shaft 224 rotates in a single rotational direction so that backlash does not come into play in positioning the convertible knuckle idlers 206. The gearmotor 234 is provided with an internal brake to lockingly retain the worm shaft 224 in a desired position, which position can be indicated in a common manner, such as by providing a close proximity sensor and appropriate indicating targets (not shown) on one of the rotating worm gears 222 to control the gearmotor 234 to stop and brake at the flange 126 up and flange 126 down operable positions, as desired.

Referring back to FIG. 11, it will be noted that, regardless of the direction the flange 124 is bent, the degree of bend at each pass is determined by the inclined support provided by the knuckles 208, 212. The convertible knuckle idler 206 is necessarily supported so that a tangential intercept point 236 is coextensive with a rotational axis 238 of the tail portion 214, so that the degree of bending downward shown in FIG. 9 is the same magnitude as the degree of bending upward shown in FIG. 11. Preferably, the bending imparted by the first pass, either upward or downward, is about a 15 degree bend.

Figure 14:
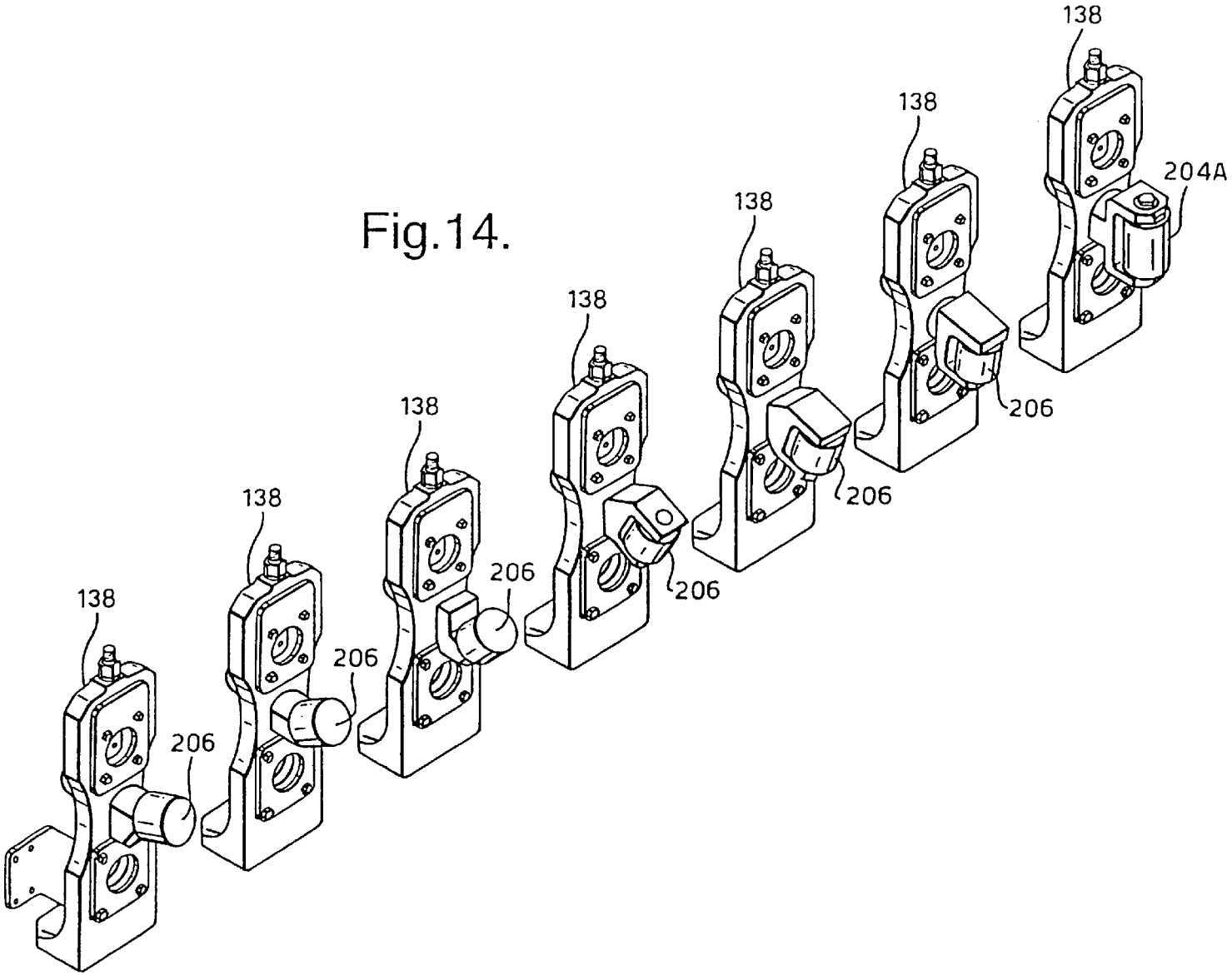
FIG. 14 is a semi-detailed, diagrammatical depiction of the serially arranged passes of the roll forming apparatus of FIG. 1 and showing the several knuckle idlers.
Figure 15:
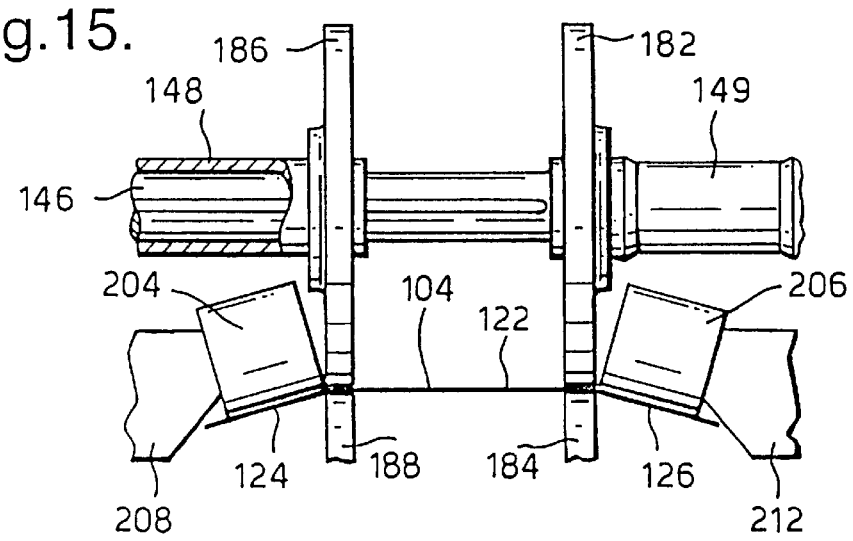
FIGS. 15 through 21 are elevational views of the first pass through the seventh pass, respectively, of the roll forming apparatus of FIG. 1 showing the knuckle idlers progressively forming the flanges on the strip material.
Figure 16:
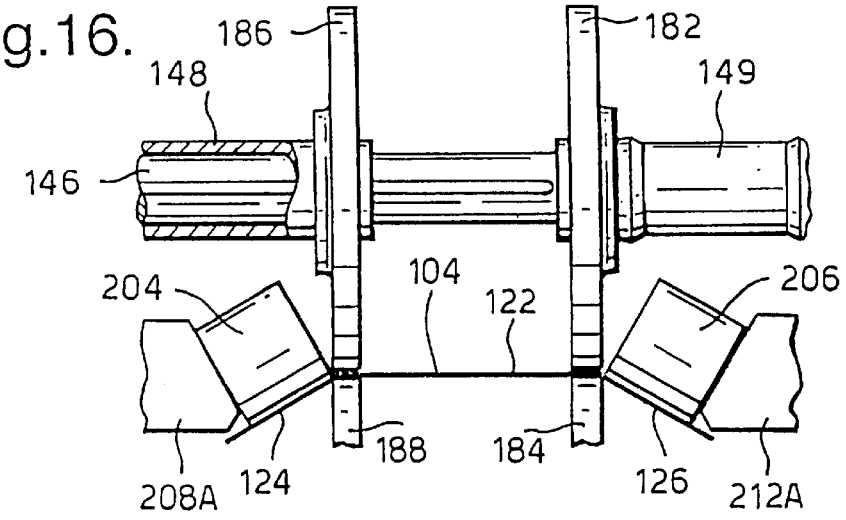
Figure 17:
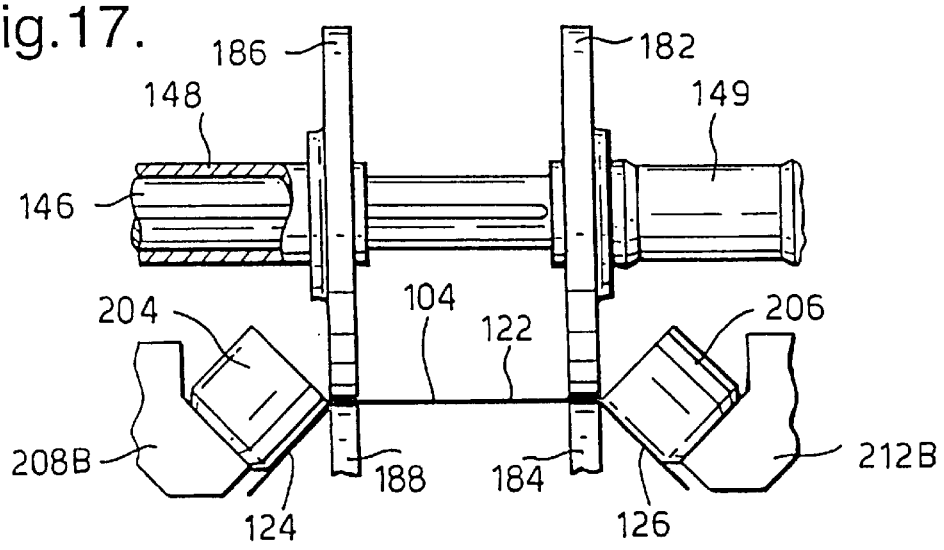
Figure 18:
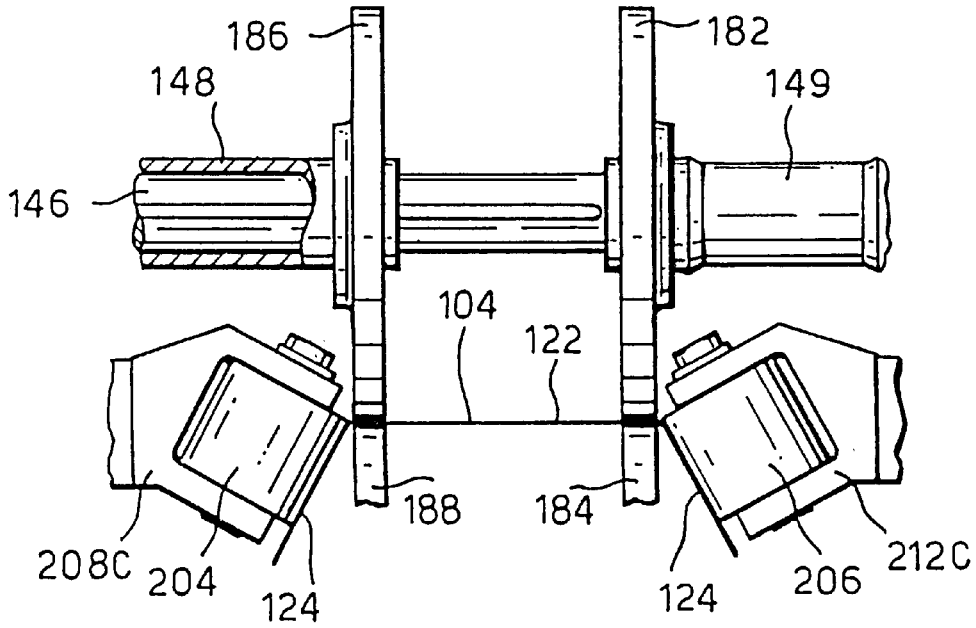
Figure 19:
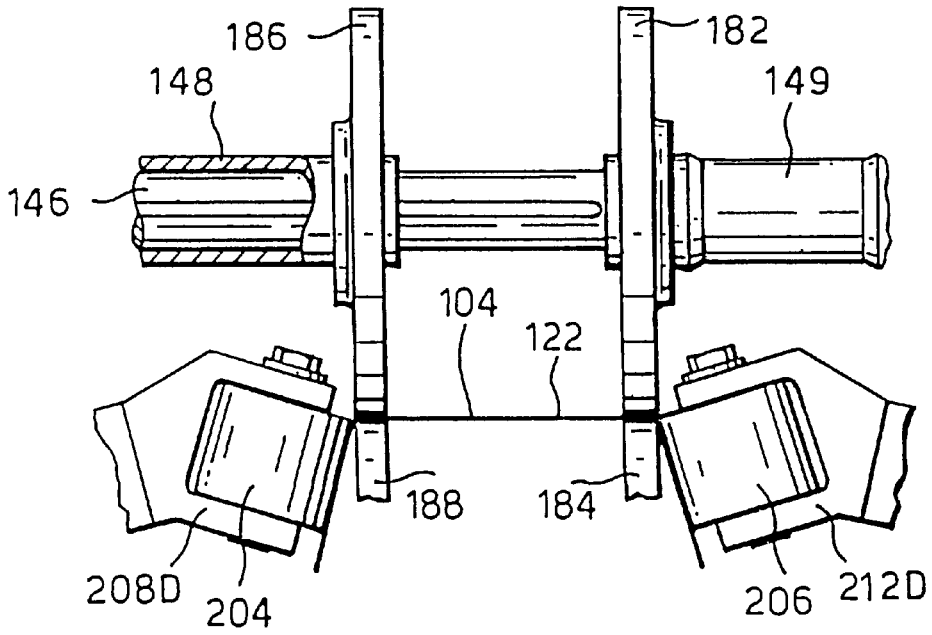
Figure 20:
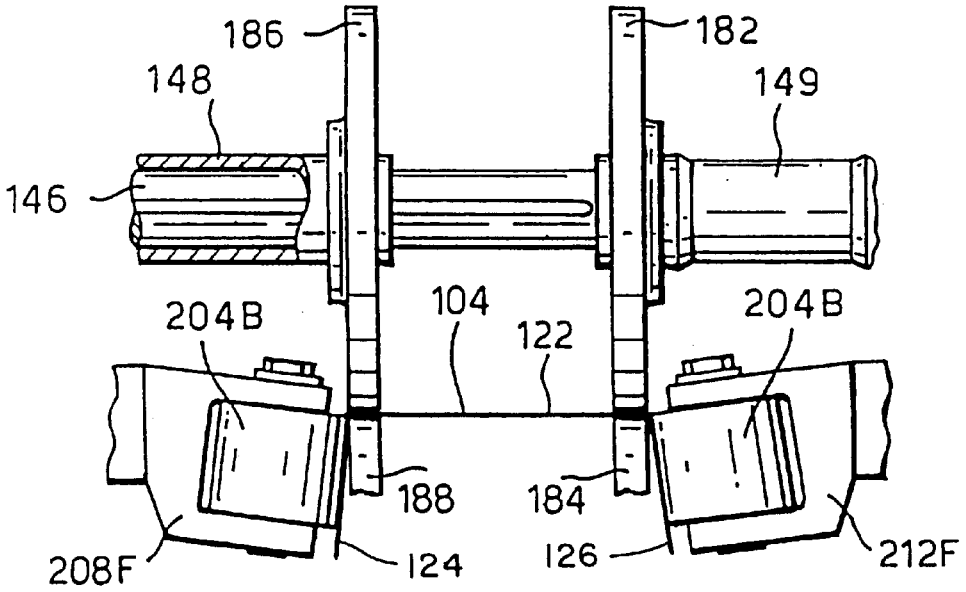

FIG. 14 is a diagrammatical, perspective representation showing the progressively angled support of the convertible knuckle idlers 206 in the first seven passes in forming the flange 126 to finally assume a 90 degree downward bend. Although the convertible knuckle idlers 206 are shown in FIG. 14, the fixed knuckle idlers 204 are opposingly supported in a like manner. FIGS. 15 through 21 show sectional views of both knuckle idlers 204, 206 at each of the first seven passes, with each of the figures showing the bend forming at that stage as the strip material 104 is progressively formed into the shape of a cee channel.

Figure 21:
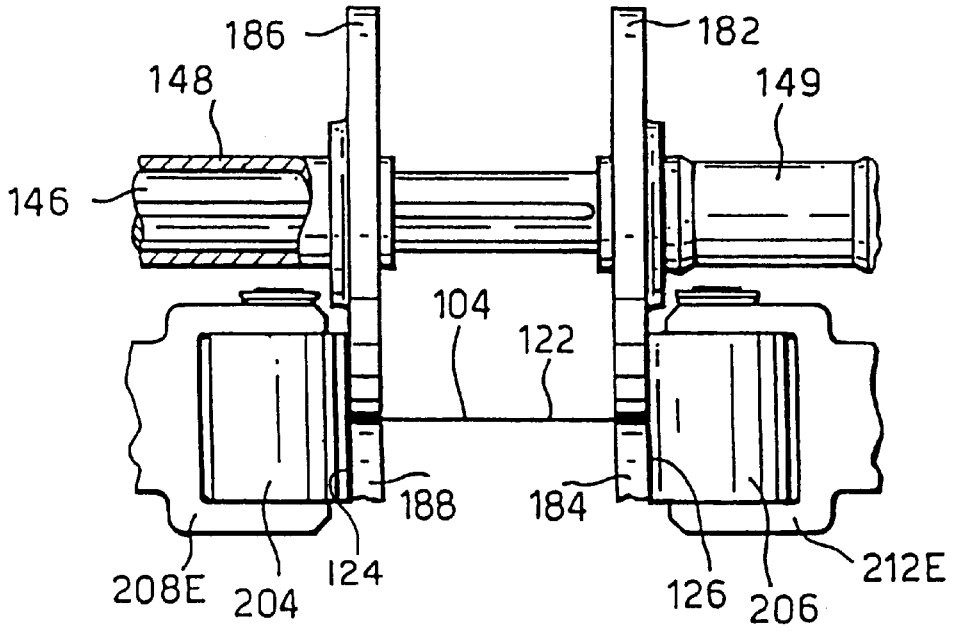

Preferably, each of the knuckle idlers 204, 206 incrementally form the flanges 124, 126 a predetermined amount, such as wherein with regard to the web 122 the first pass forms the flange 15 degrees (shown in FIG. 15); the second pass 30 degrees (shown in FIG. 16); the third pass 45 degrees (shown in FIG. 17); the fourth pass 60 degrees (shown in FIG. 18); the fifth pass 72 degrees (shown in FIG. 19); the sixth pass 82 degrees (shown in FIG. 20); and the seventh pass 90 degrees (shown in FIG. 21). In FIGS. 15 through 21, showing the first seven passes, it will be noted that the knuckle idlers 204 are supported by the knuckles 208 and 208A through 208E; and that the idler 204A is supported by the knuckle 208F.

Of course, the bend angles and number of passes represented herein are exemplary and not exhaustive of the totality of embodiments within the contemplation of the present invention as described and claimed, wherein the number of flange forming passes and incremental forming is dependent on the complexity of the formed part and the material and surface characteristics of the material being formed. It will be noted that, in the seventh pass which forms a 90 degree flange, the convertible knuckle idler 206 at this pass can be replaced with an enlarged, fixed knuckle idler 204A because a 90 degree bend upward or downward can be formed with the enlarged, fixed knuckle idler 204A that is sufficiently dimensioned to form both directions.

Once the flanges 124, 126 have been formed into the 90 degree bend profile, it is usually necessary that a straightening operation be performed on the worked sheet material 104. Referring once again to FIG. 7, a straightener means is provided to work the strip material on both the inboard and outboard side to straighten the formed flanges 124, 126. An outboard straightener 240 is provided to square the downwardly formed flange 124. As discussed previously, on the inboard side the flange 126 can be formed either downward (for a cee purlin or channel) or upward (for a zee purlin), so an inboard cee straightener 242 and an inboard zee straightener 244 are provided accordingly.

Figure 22:
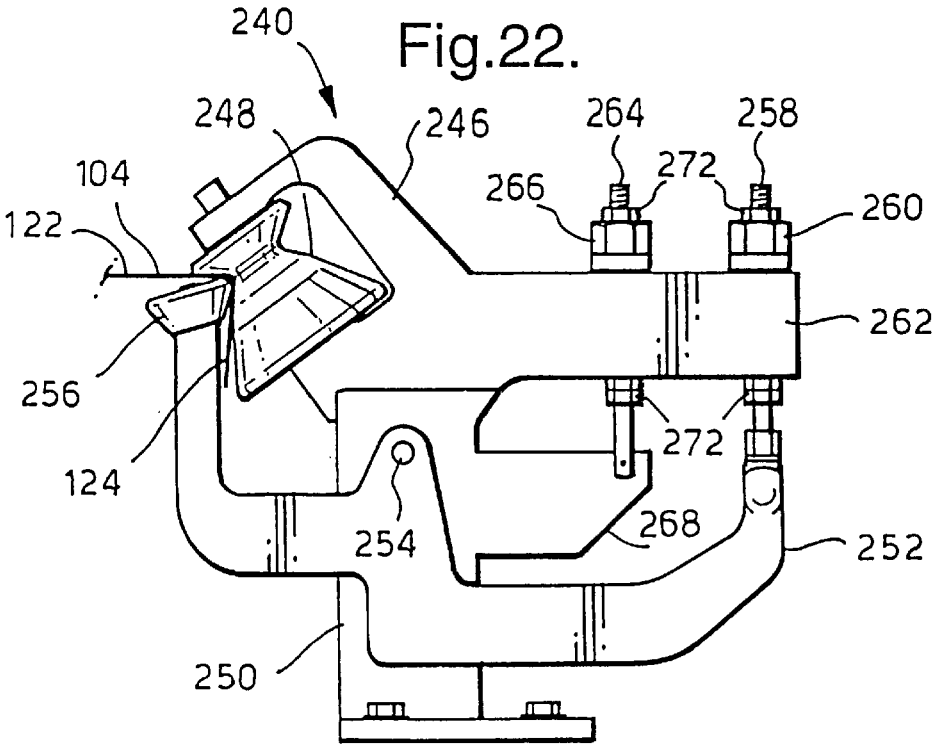
FIG. 22 is a semi-detailed, elevational view of the outboard cee straightener.
Figure 23:
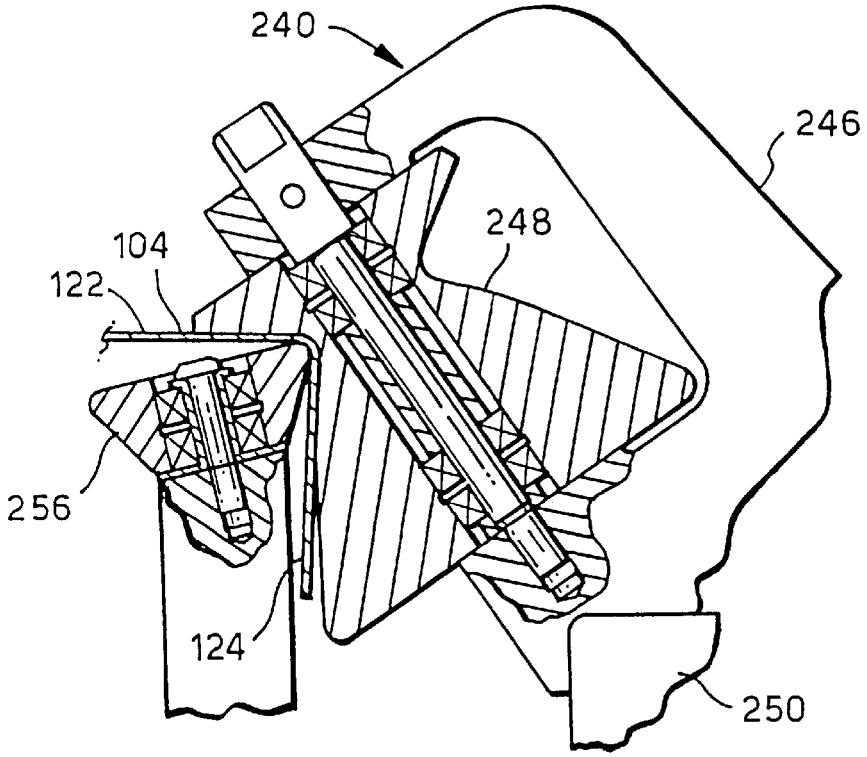
FIG. 23 is a partial sectional detail view of the idlers of the outboard cee straightener of FIG. 22.

FIGS. 22 and 23 show the outboard straightener 240, and a description thereof will make clear the manner in which the flange 124 formed by the outboard side of the convertible roll forming apparatus 100 is straightened and squared as required prior to entering the lip forming rollers described below. The outboard straightener 240 has an idler block 246 supporting a female idler 248. The idler block 246 is supported by an upstanding support 250 in a manner allowing vertical positioning of the idler block 246. An idler pivot arm 252 is joined by a pinned connection 254 to the upstanding support 250. This pinned connection 250 is strategically located such that the forming radius of a male idler 256 moves generally along the bisect of the angle formed by the forming surfaces of the female idler 248 thus providing generally equal clearance to both of the forming surfaces of the female idler 248 and the forming radius of the male idler 256 thus enhancing the convertible roll forming apparatus 100 ability to overbend and straighten a wide gauge range of worked sheet material 104. Idler pivot arm 252 supports at a distal end thereof a male idler 256 that cooperates with the female idler 248 to provide a final characteristic to the flange 124 as described below.

The outboard straightener 240 can provide a desired over-bend characteristic to the flange 124 by adjusting a first adjustment rod 258. The first adjustment rod 258 is threadingly engaged with a sleeve 260, the sleeve 260 supported by a lever portion 262 of the idler block 246. The adjustment rod threadingly passes through the sleeve 260 and clearingly passes through the lever portion 262, and is connected at a distal end thereof to the idler pivot arm 252. Rotation of the sleeve 260 thereby causes a threading advancement of the adjustment rod 258. An upward advancement of the adjustment rod 258 urges the male idler 256 away from the female idler 248 which tends to disengage the male idler 256 from the flange 124. When disengaged, the flange 124 passes by the outboard straightener 240 without effect. Conversely, a downward advancement of the adjustment rod 258 urges the male idler 256 toward the female idler which tends to provide an over-bend characteristic to the flange 124.

It will be recognized that the male idler 256 and female idler are matingly tapered so as to provide a rolling point contact therebetween. This prevents a wiping action by the idlers 248, 256 against the strip material 104 so as to minimize any frictional marring of the strip material 104 surface. This feature makes the convertible roll forming apparatus 100 of the present invention well suited for roll forming on surface-sensitive materials, such as pre-painted material.

A second adjustment rod 264 is likewise threadingly engaged with a sleeve 266 and clearingly passes through the lever portion 262, with a distal end thereof connected to a flange portion 268 of the support 250. By rotating the sleeve 266 the lever portion 262 is urged toward or away from the flange portion 268, thereby affecting the vertical position of the idler block 246 and hence the vertical position of the female idler 248. This adjustment provides "ski and dive control" of the strip material, that is, correction for upwordly bending ("ski") or downwardly bending ("dive") strip material 104 coming from the flange forming roller passes.

It will be evident as to the manner in which the adjustment rods 258, 264 can be used cooperatively to form a desired characteristic of the flange 124. A number of locking nuts 272 threadingly engage the adjustment rods 258, 264 and are tightened against the sleeves 260, 266 and the lever portion 262 to lock the adjustment rods 258, 264 in a desired position.

Where the outboard side of the convertible roll forming apparatus 100 requires a straightener assembly capable of working on flanges 124 formed in a downward direction, the inboard flange 126 can be either upwardly or downwardly pointing. Therefore, the inboard cee straightener 242 and the inboard zee straightener 244 automatically engage or clearingly disengage the flange 126 in response to the corresponding setting of the convertible knuckle idlers 206.

Figure 24:
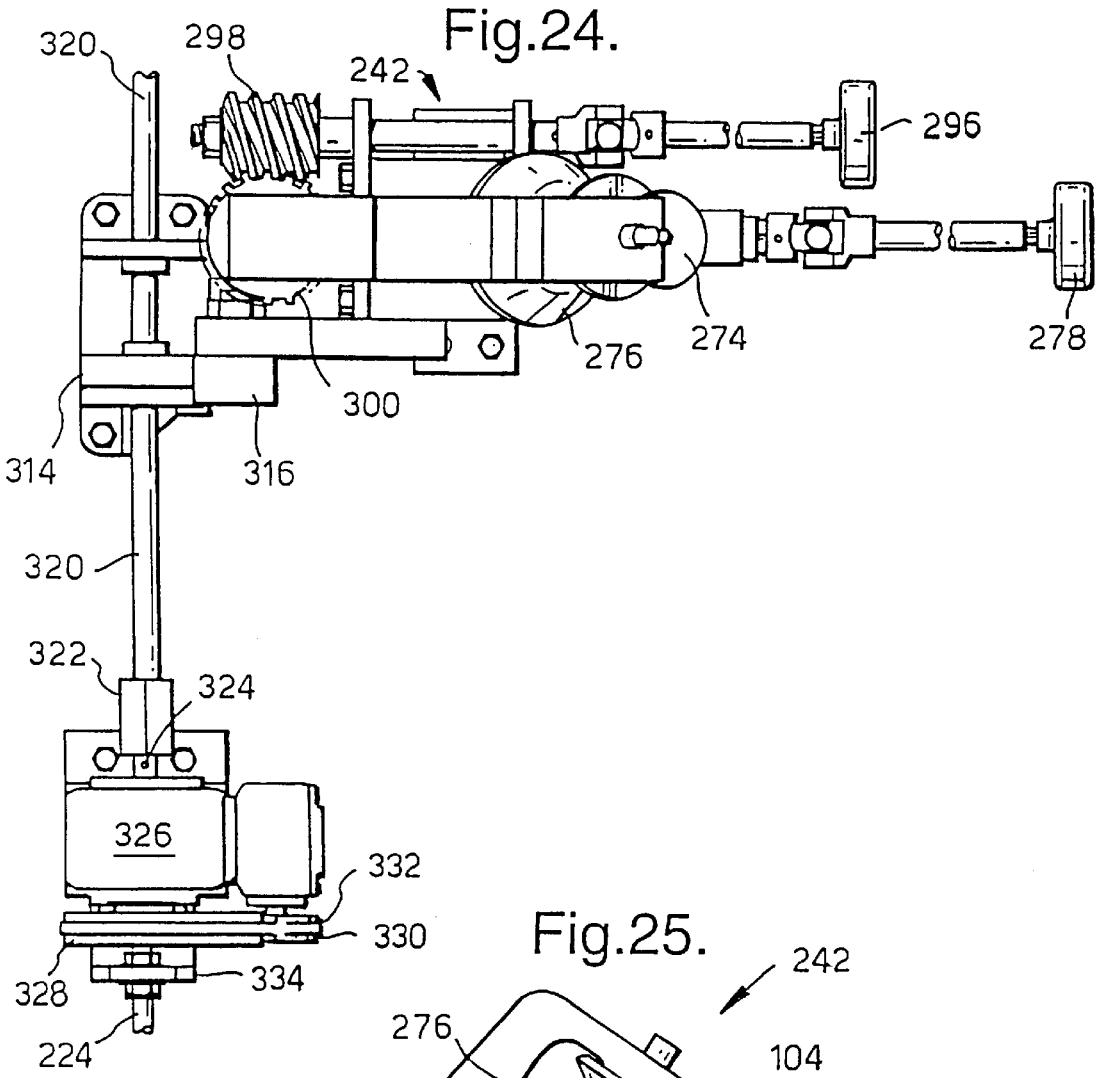
FIG. 24 is a semi-detailed, top view of the inboard cee straightener.
Figure 25:
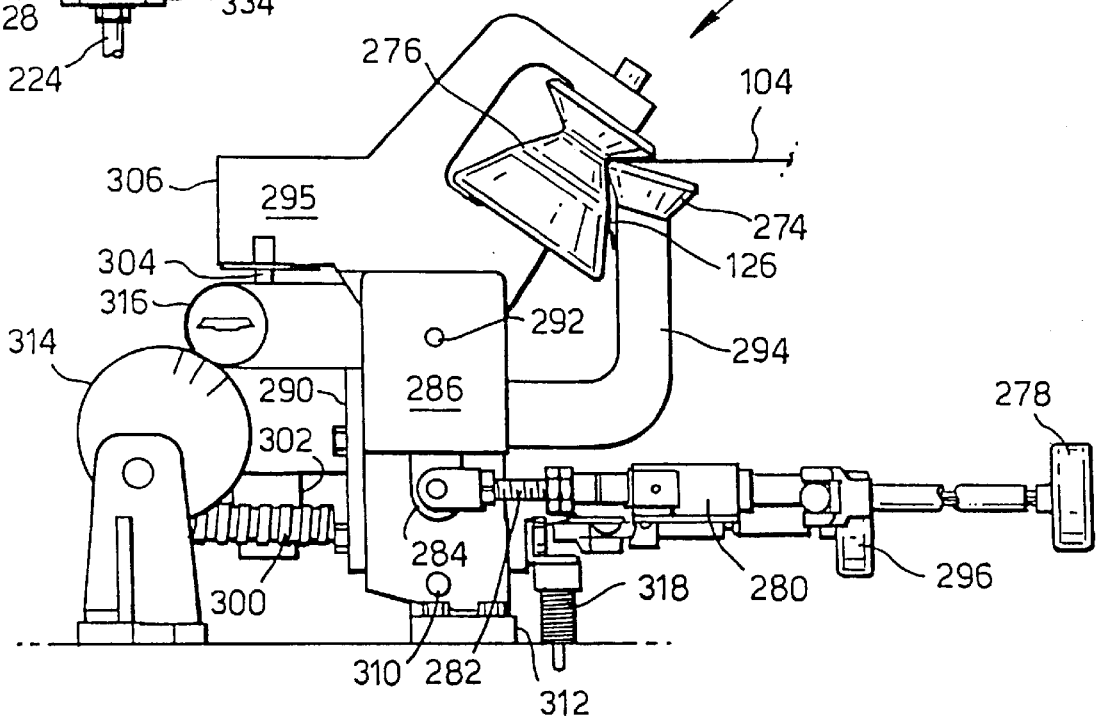
FIG. 25 is a semi-detailed, elevational view of the inboard cee straightener of FIG. 24.

As shown in FIGS. 24 and 25, the inboard cee straightener 242 has a male idler 274 that cooperates with a female idler 276 to impart a desired characteristic to the inboard flange 126 in a similar manner as described previously for the outboard flange 124. A first handwheel 278 is connected to a linearly stationary threaded sleeve 280 which threadingly advances a threaded rod 282 connected to a yoke portion 284 of a mounting block 286. The mounting block 286 is pivotally positionable about a pinned connection 292 with the pinned connection 292 strategically located such that the male idler 274 generally moves along the bisect of the angle formed by the forming surfaces of the female idler 276 thus providing clearance to the forming radius of the male idler 274 and the forming surfaces of the female idler 276 for reasons previously described. The male idler 274 is journalled to a idler pivot arm 294 depending from the mounting block 286. In this manner, rotation of the first handwheel 278 to place the threaded rod 282 in compression urges the male idler 274 to clearingly disengage the female idler 276. Conversely, rotation of the first handwheel so as to pivot the male idler 274 against the female idler 276 tends to produce an over-bend in the flange 126, as described above.

Similar to that described for the outboard straightening 240, the female idler 276 is journalled to an idler block 295 that is vertically positionable relative to the mounting block 286 in order to provide ski and dive characteristic control. A second handwheel 296 is connected for rotational movement of a worm 298, as viewed in FIG. 24, which imparts rotation to a worm gear 300. The worm gear 300 is connected to a shaft 302 which at a distal end 304 threadingly engages the idler block 288. Rotation of the second handwheel 296 thereby vertically positions the idler block 295, and hence the female idler 276, in order to provide the ski and dive control. Preferably, the handwheels 278, 296 are provided with a conventional indicator dial (not shown) which provides a quantitative indication of the advancement thereof.

When forming a cee purlin 118 or cee channel 120, that is, when the inboard flange 126 is downward as represented in FIG. 9, the inboard cee straightener 242 described above is operably engaged. When forming a zee purlin 116, however, the inboard cee straightener 242 is necessarily clearingly recessed. Otherwise, the upwardly extending flange 126 of a zee purlin 116 would impact against the female idler 276 and supporting idler block 288, because both interfere with the motion of an upwardly extending flange 126 along the feed direction toward an egress.

For purposes of clearingly recessing the inboard cee straightener 242, the support 290 is pinned for rotation about a pinned connection 310 with a supporting base member 312. To position the inboard cee straightener 242 in the operable position as shown in FIG. 25, an eccentric cam 314 cammingly engages a cam follower 316 that is, in turn, supported by the support 290, to attain the operable position. In the operable position a return spring 318 is essentially fully compressed so as to provide columnar rigidity to the support 290. When the eccentric cam 314 is rotated 180 degrees the return spring 318 biases the support 290 in a counter-clockwise pivotation about the pinned connection 310 to operably move the extending portions of the inboard cee straightener 242 in an arcuate path that clearingly recesses away from the upstanding zee flange 126.

The eccentric cam 314 is rotated by action of the worm shaft 224 (see FIG. 13) which rotates as described previously to pivot the convertible knuckle idlers 206 to the flange 124 up or flange 124 down position, corresponding respectively to the zee forming or cee forming position. In this manner, activation of the worm shaft 224 automatically positions the inboard cee straightener 242 either in the operable position or in the clearingly recessed position.

To that end, FIG. 24 shows the eccentric cam 314 is rotatably supported about a shaft 320 that is connected by a coupling 322 to an output shaft 324 of a gear reducer 326. Driving the gear reducer 326 is a sprocket 328 aligned with an input sprocket 330 of the gear reducer 326 and a belt 332 trained therebetween. The driving sprocket 328 is connected by way of a connector 334 to a distal end of the worm shaft 224, as best illustrated in FIG. 13.

Figure 26:
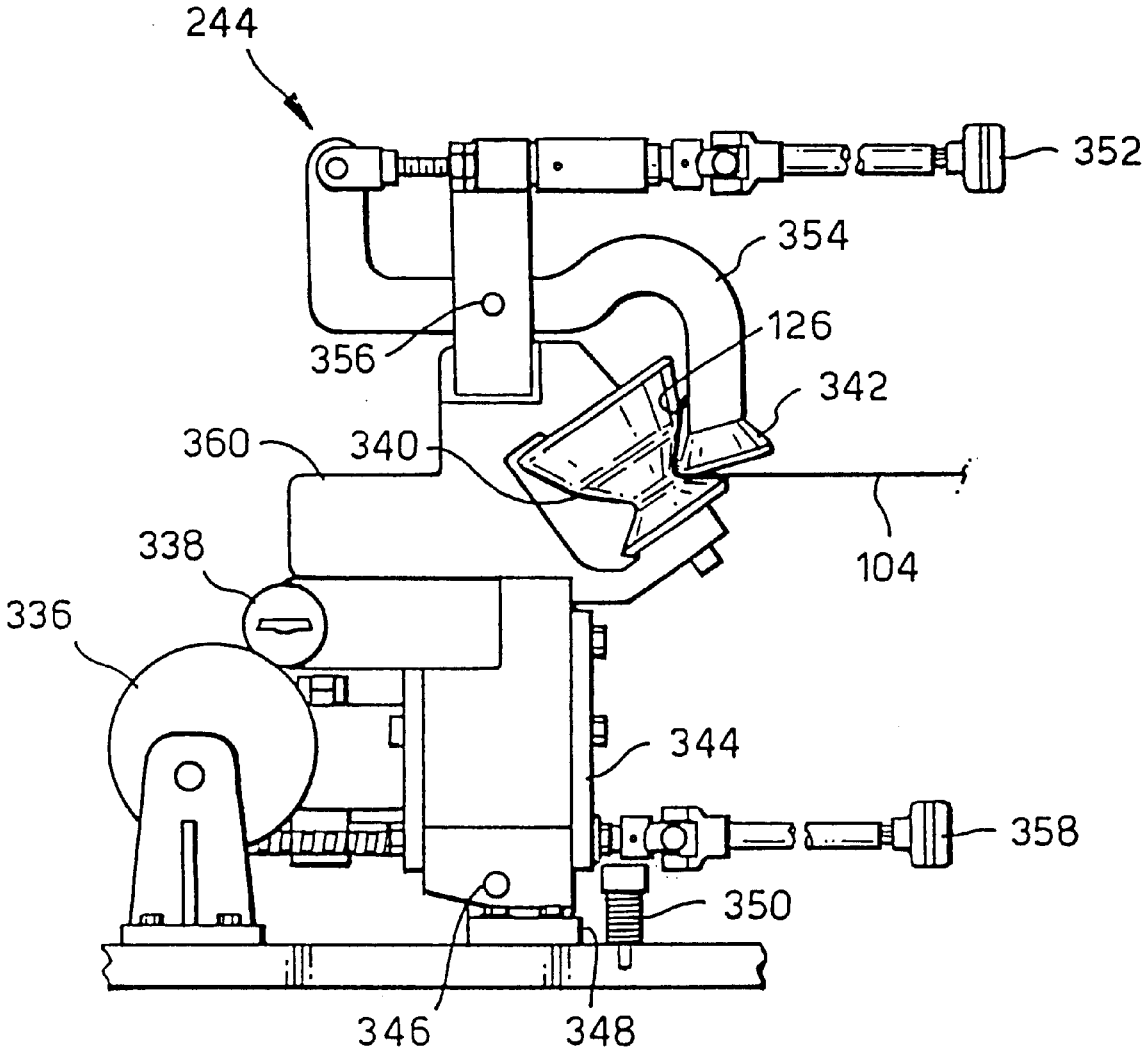
FIG. 26 is a semi-detailed, elevational view of the inboard zee straightener.

FIG. 24 shows only a portion of the shaft 320, the distal end thereof being attached to a similar camming arrangement in the inboard zee straightener 244 which is shown in an operable position in FIG. 26. In the operable position an eccentric cam 336 cammingly engages a cam follower 338 to pivot a female idler roller 340 and male idler roller 342 into operable position as a support 344 pivots about a pinned connection 346 with a base member 348. A return spring 350 similarly biases the support 344 in a counter-clockwise rotation when the eccentric cam 336 is rotated, and thus the extending portions of the female idler roller 340 and supporting structure are clearingly recessed so that a downwardly projecting cee purlin flange 126 can clearingly pass when the eccentric cam 336 is rotated 180 degrees from the position illustrated in FIG. 26.

It will be noted that since the eccentric cams 314, 336 are rotated by the common shaft 320, the eccentric cam 314 is positioned 180 degrees out of phase with that of the eccentric cam 336 so that only one of the two inboard straighteners 242, 244 is in the operable position at any given time.

In a manner similar to that described above, FIG. 26 shows the inboard zee straightener 244 has a first handwheel 352 that threadingly advances an idler pivot arm 354 about a pinned connection 356 to position the male idler roller 342 relative to the female idler roller 340. The pinned connection 356 is located in a manner described above such that the male idler 342 moves generally along the bisect of the angle formed by the surfaces of female idler 340 for the reasons previously described. In a manner like that of the inboard cee straightener 242, a second handwheel 358 vertically positions an idler block 360 to provide ski and dive control. The combined action of the handwheels 352, 358 provides the opportunity to impart desired characteristics to the upwardly extending inboard flange 126 of the zee purlin 116.

After the strip material 104 has passed the flange 124, 126 forming rollers in the first seven passes and the straighteners, a lip forming section 362 of lip forming rollers is encountered. In the presently described embodiment, forming of the lips 128, 130 is performed in six passes of opposed idler assemblies that progressively form the lip flanges 128, 130 at the distal ends of the formed flanges 124, 126.

FIG. 7 shows a series of six inboard lip rollers 364, 366, 368, 370, 372, and 374; and six outboard lip rollers 365, 367, 369, 371, 373, and 375. The several support stands 138, 140 in the lip forming section 362 support roller assemblies 142, 144 (FIG. 9) that hold opposing pairs of drive rollers 376 between the adjacent lip rollers 364 through the lip rollers 375. However, unlike the paired tooling rollers 182, 184 and 186, 188, in the flange forming section 141, the drive rollers 376 are paired to grippingly move the strip material 104 in the feed direction and do not participate directly in the formation of the lips flanges 128, 130. As such, the drive rollers 376 need not be as substantial as the tooling rollers 182, 184 and 186, 188 and necessarily are narrower in order to permit the lip flanges 128, 130 to clearingly pass thereby.

Figure 27:
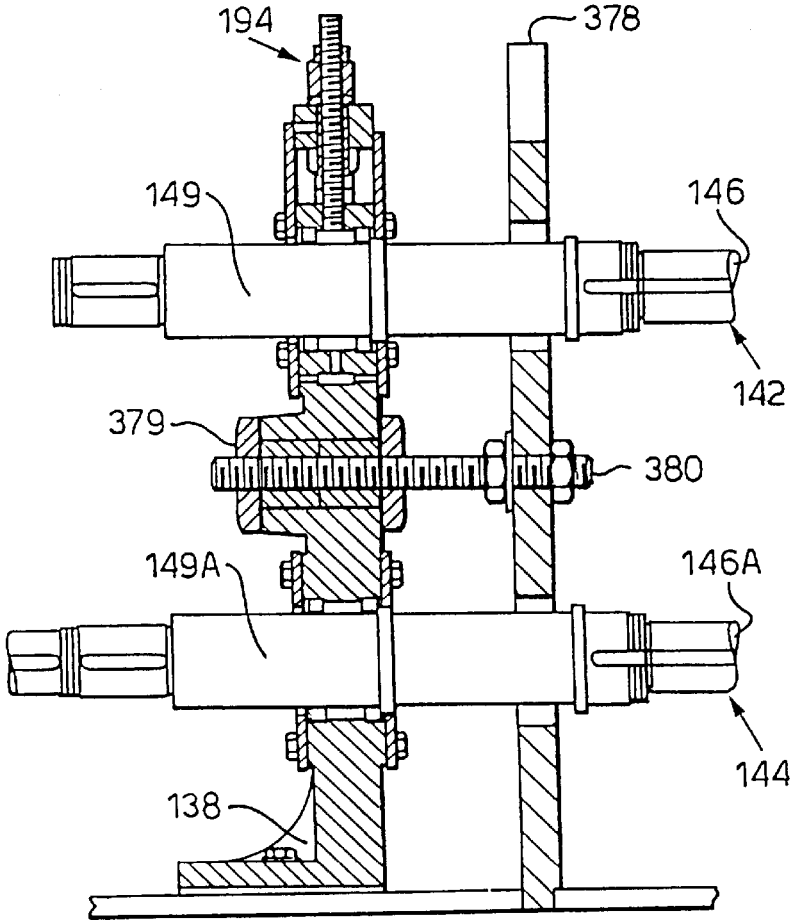
FIG. 27 is a partial sectional view of the wall which supports the lip flange idlers.

As shown in FIG. 7, a pair of opposing support walls are supported by the support stands 138, 140 and by the respective bases 134, 136, and there extend the length of the lip forming section 362. A number of openings are provided in the support walls 378 and the lip rollers are receivingly disposed in these openings. FIG. 27 illustrates the manner in which each wall 378 is supported by extending fasteners 380 (one shown) from the support stands 138 and securing the fasteners 380 via appropriate nuts and spacers 379 in a central bore of the support stands 138. The support stands 138 also support upper and lower roller assemblies 142, 144 for the drive rollers 376 (not shown in FIG. 27).

Figure 28:
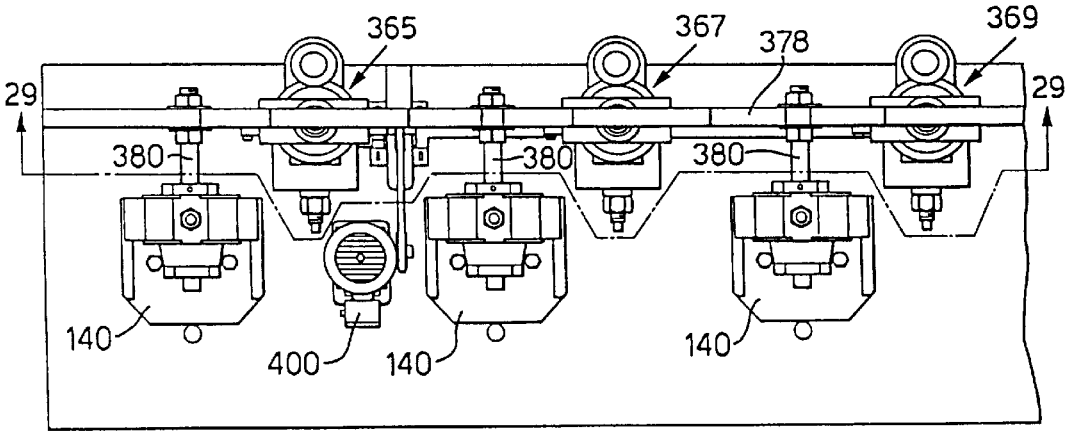
FIG. 28 is a top view of the first three outboard lip flange idler passes of the roll forming apparatus of FIG. 1.
Figure 29:
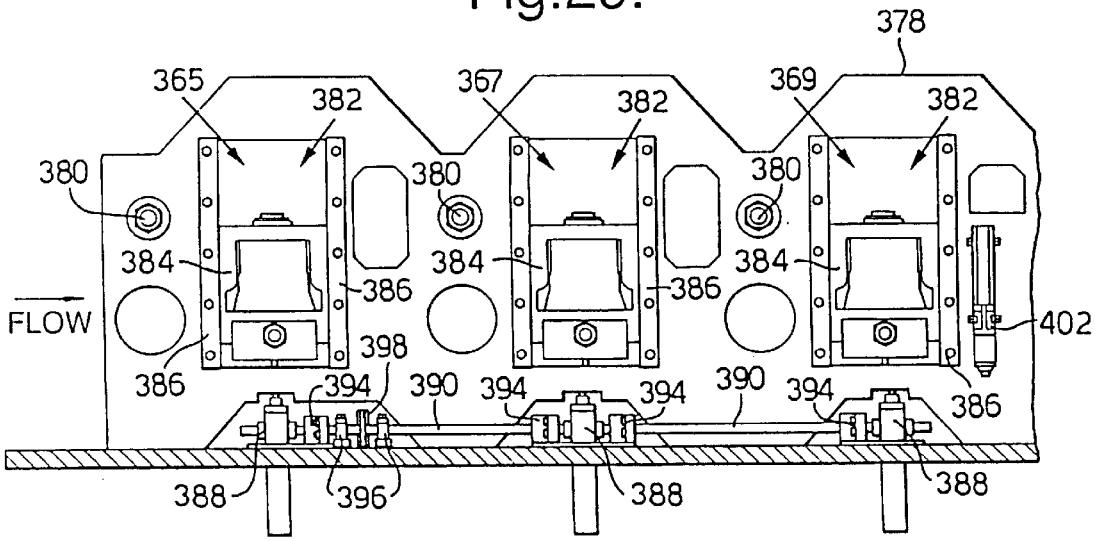
FIG. 29 is an elevational view taken at 29—29 in FIG. 28.

FIGS. 28 and 29 show the first three outboard lip rollers 365, 367, 369 in the manner of support within openings 382 in the wall 378. A roller idler block 384 slidingly engages a pair of vertical guides (not shown) along the vertical edges in each of the openings 382, and pairs of retention plates 386 sandwich each guide and idler block 384 for vertical movement of the idler blocks 384 within the openings 382.

Each idler block 384 is moveable vertically by a jack screw 388 that threadably engages the idler block 384 at a lower end thereof. All three jack screws 388 are joined by a pair of shafts 390, 392 joined by couplings 394. The shaft 390 is supported by a pair of bearings 396 and a sprocket 398 is interposed therebetween to transfer rotary motion from a gear brakemotor 400, as shown in FIG. 28. A position sensor 402 is attached to one of the idler blocks 384 to provide closed-loop control of the gear brakemotor 400 in order to vertically position the outboard lip rollers 365, 367, 369.

Figure 30:
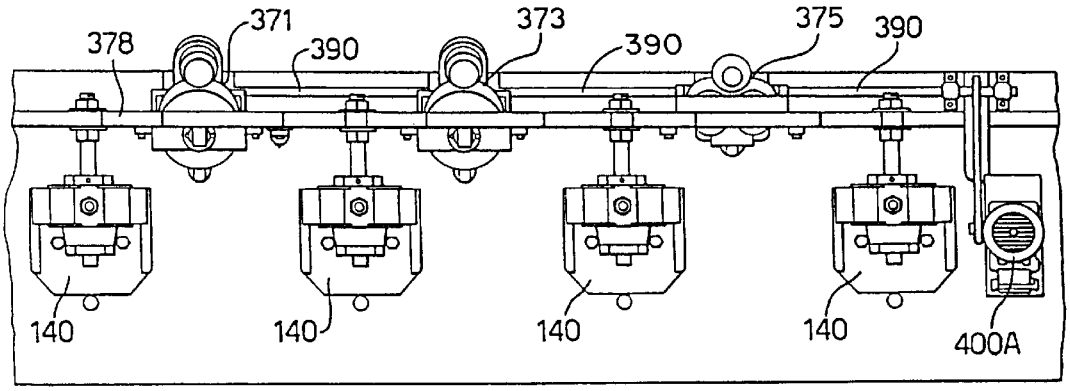
FIG. 30 is a top view of the last three outboard lip flange idler passes of the roll forming apparatus of FIG. 1.
Figure 31:
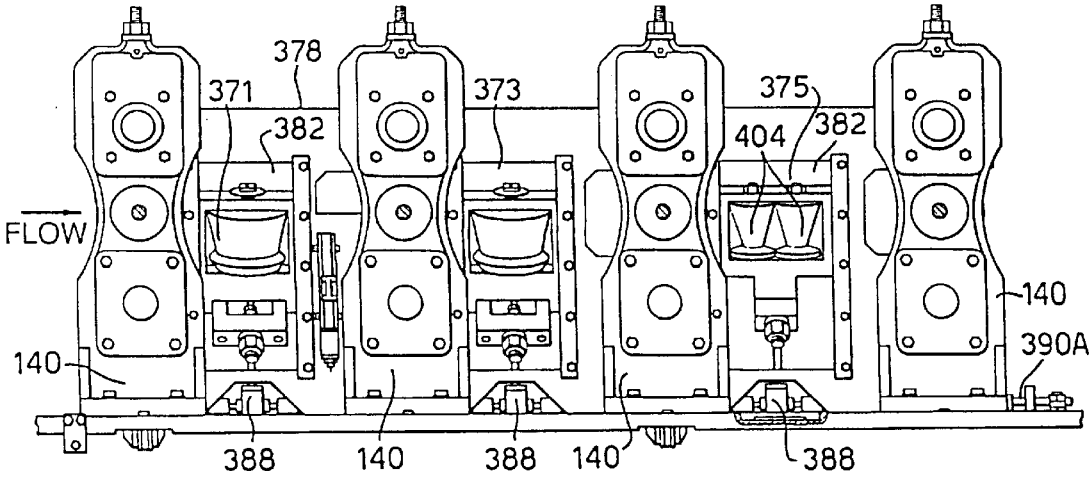
FIG. 31 is a partial elevational view of the last three outboard lip flange idler passes of FIG. 30.

FIGS. 30 and 31 show the last three outboard lip rollers 371, 373, 375 which are similarly supported and vertically moveable, as previously described for the outboard lip rollers 365, 367, 369, within respective openings 382 in the support wall 378. The vertical adjustment of the outboard rollers 371, 373, 375 is effected in like manner via jack screws 388 commonly interconnected via shafts 390A driven by a gear brakemotor 400A. It will be noted that the last outboard roller 375 utilizes two female idler rollers 404 and one male idler roller 406 (see FIG. 34) to advantageously provide flare control to the formed part as is conventionally performed with a three-roller arrangement at the final pass of a roll forming machine.

Figure 34:
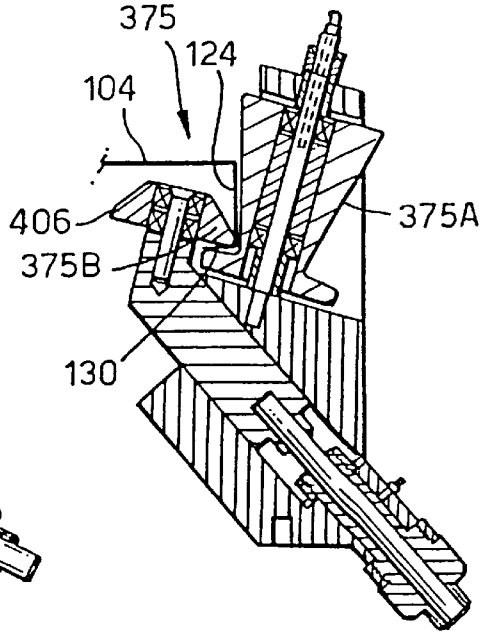
FIGS. 32 through 34 are partial sectional, diagrammatic representations of the first, fourth and sixth idlers in the lip forming passes of the roll forming apparatus of FIG. 1.
Figure 33:
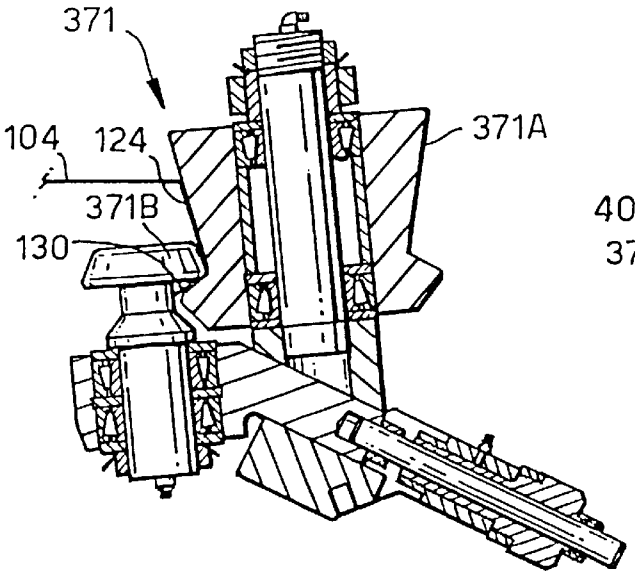
Figure 32:
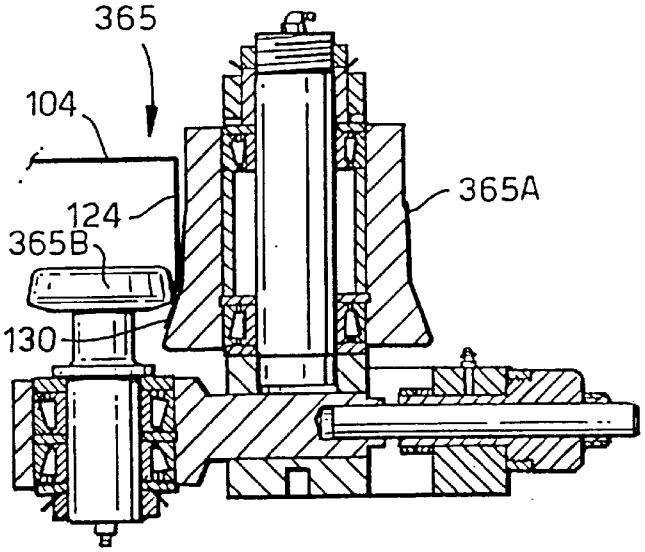
Figure 35:
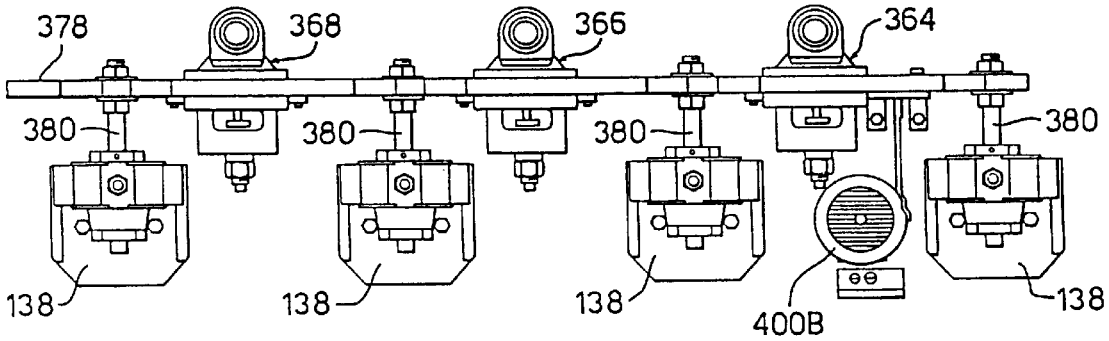
FIG. 35 is a top view of the first three inboard idler passes of the roll forming apparatus of FIG. 1.
Figure 36:
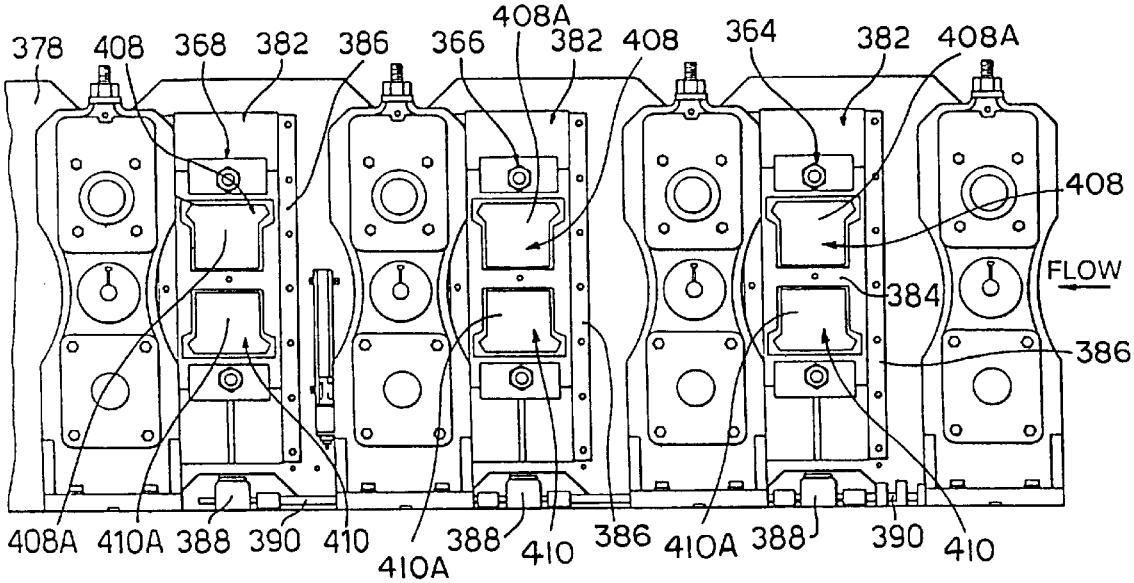
FIG. 36 is an elevational view of the first three inboard idler passes of FIG. 35.
Figure 37:
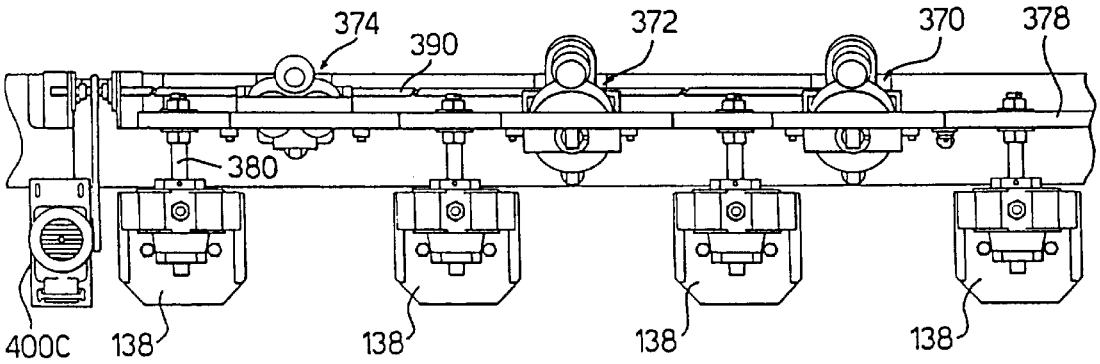
FIG. 37 is a top view of the last three inboard idler passes of the roll forming apparatus of FIG. 1.

FIGS. 32 through 34 illustrate the general progression in tooling used in forming the lip flange 126, wherein FIG. 32 is a partial sectional view of the first outboard lip roller 365 (with supporting structure omitted for clarity), FIG. 33 is the fourth roller 371, and FIG. 34 is the sixth and final roller 375. FIG. 33 is representative of the fourth lip forming passes and is designed so that the male idler 371B generally moves along the bisect of the angle formed by the forming surfaces of idler 371A thereby maintaining generally equal clearance to both forming surfaces of the female roll and the male forming radius as the male idler 371B is adjusted throughout a desired range. FIG. 34 shows that the adjustment of the male idler 406 is designed similar to FIG. 33 in that the male idler 406 moves generally along the bisect of the angle formed by the two forming surfaces of female idler 375A. Idler 375A in FIG. 34 may be used in pairs or singularly by removal of one or the other or the removal of idler 406 to produce difference effects on the strip material 104. It will be understood that the roll forming tools are vertically positionable as described above in order to provide various lip flange lengths and to provide lip flanges on various size flange lengths.

FIGS. 35 through 38 show the inboard lip rollers 364, 366, 368, 370, 372, 374. From an understanding of FIG. 36 it will be noted that the first three rollers 364, 366, 368 each has an upward roller set 408 for forming a lip on a zee purlin 116, and a downward roller set 410 for forming a lip on a cee purlin 118. The inboard lip forming assemblies are otherwise supported and vertically positionable in a similar manner as that described above and a detailed description is thus not necessary for a complete understanding of the present invention.

The discussion will now turn to the drive train assembly that drives the tooling rollers 182, 184, 186, 188 and the drive rollers 376. FIG. 7 shows a pair of motors 412 that are connected to a plurality of gearboxes 414 adjacent each of the inboard support stands 138 with the exception of the fourth and eleventh. In the preferred embodiment as shown the motors 412 are double shafted, allowing the operable connection to gearboxes 414 on both sides of each motor 412. A coupling connector 416 connects adjacent gearboxes 414, and a coupling connector 418 connects the gearboxes 414 to the motor 412.

In this manner it will be noted that the motors 412 are linked together in a continuous drive train in powering both the tooling rollers 182, 184 and 186, 188, and the drive rollers 376. It has been found that linking both motors in this manner is advantageous in maximizing the available motor torque available and in maintaining a relatively constant feed velocity through the roll forming apparatus 100. Alternatively, the motors could independently drive portions of the roll forming apparatus 100, with electronic motor controls provided to ration the necessary torque to the driven portions.

FIG. 9 illustrates the manner in which the drive train transfers power in all the passes with the exception of the fourth and eleventh passes. Here the gear box 414 is connected to the extension 180 so as to rotate the lower roller assembly 144. A gear 420 is keyed to the gear receiving extension 156 (FIG. 10) of the lower roller assembly 144 and secured with a locking nut 422 on the threaded portion 160 (FIG. 10). A mating gear 424 is similarly mounted to the upper roller assembly 142 and is driven by the gear 420. In this manner the roller assemblies 142, 144 rotate in opposite directions so as to grippingly urge the strip material in the feed direction.

Figure 39:
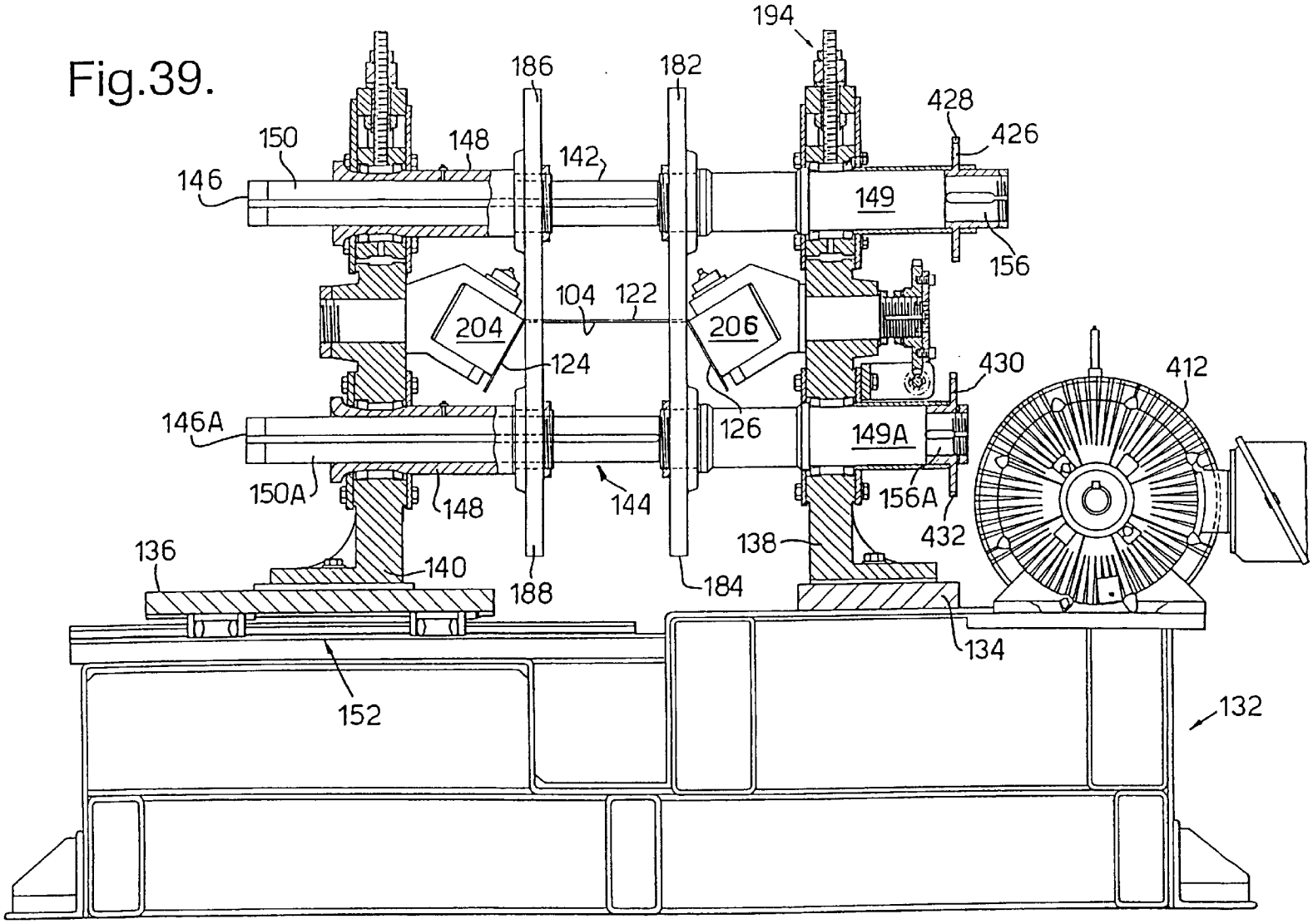
FIG. 39 is a partial sectional view in elevation representative of the first and fourth passes of the roll forming apparatus of FIG. 1 with regard to the drive train mechanism.

In the fourth and eleventh passes it will be noted that space is lacking for placement of a gear box 414 because of the placement of the motors 412. FIG. 39 shows the manner in which a sprocket 426 is mounted to the upper roller assembly 142 and aligned with a sprocket (not shown) that is mounted to the upper roller assembly of the immediately previous pass (e.g. the third pass for the fourth pass). A chain 428 (FIG. 7) is trained over the aligned sprockets so that the upstream upper roller assembly 142 drives the downstream upper roller assembly 142. In a similar manner, a sprocket 430 is mounted to the lower drive assembly 144 in FIG. 39, and a chain 432 (FIG. 7) is trained over the sprocket 430 and an aligned sprocket on the immediately downstream lower drive assembly 144. In this manner the downstream lower roller assembly 144 drives the upstream lower roller assembly 144.

Figure 40:
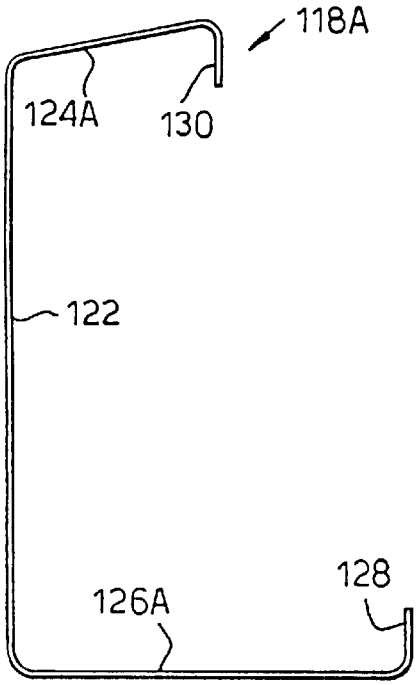
FIGS. 40–43 are sectional views of various eave strut members made by the roll forming apparatus of FIG. 1.
Figure 41:
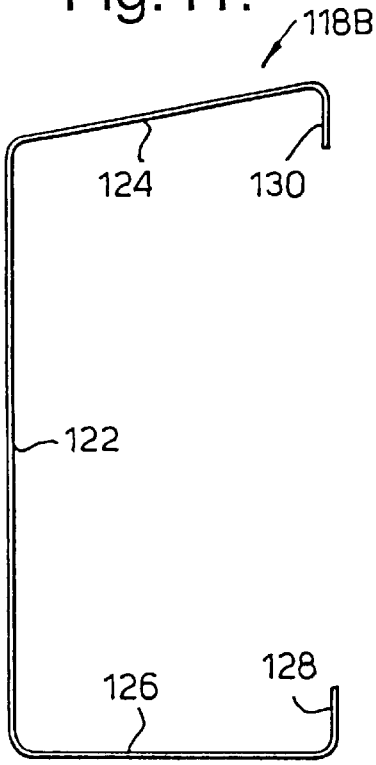
Figure 42:
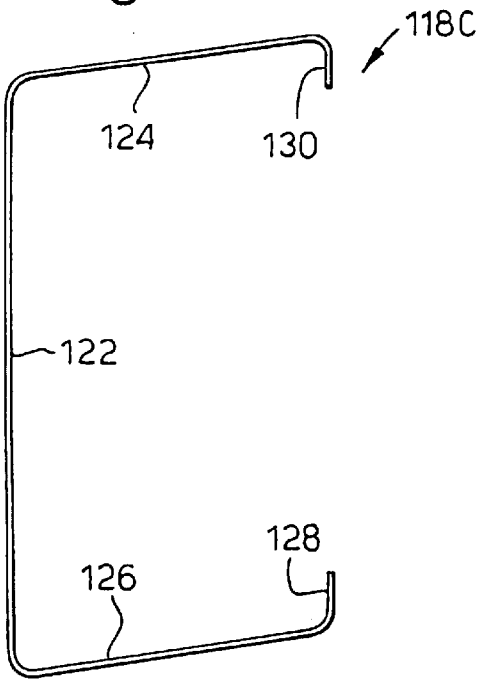
Figure 43:
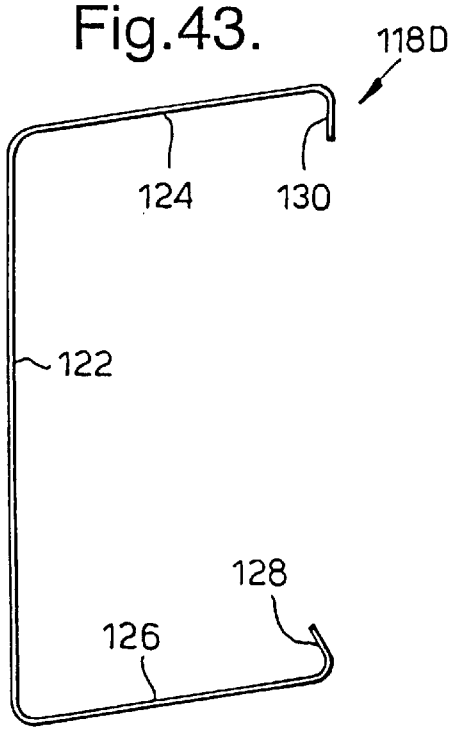
Figure 44:
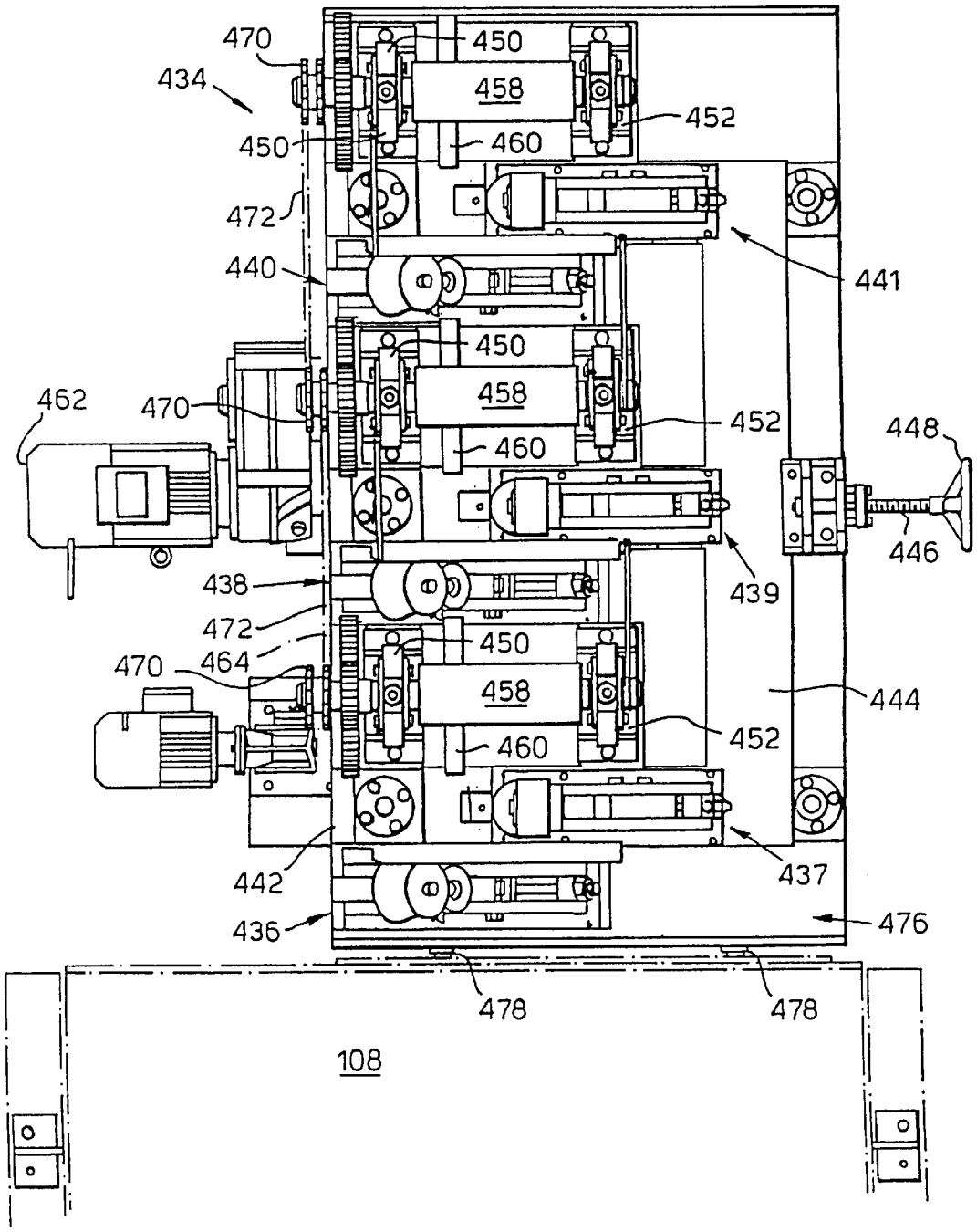
FIG. 44 is a plan view of the eave strut assembly of the roll forming apparatus of FIG. 1.

It will be recognized that in addition to cee purlins and zee purlins in a roof construction, modified purlins are usually necessary in the portions of the roof that are joined to a side wall. FIGS. 40 through 43 illustrate common types of these modified purlins, commonly referred to as eave struts, which exemplify the types of modifications that are required of otherwise common cee purlins as shown in FIG. 5. FIG. 40 shows a modified cee purlin 118A which was formed on the convertible roll forming apparatus 100 with flanges 124, 126 of unequal length, and then modified to underbend the flange 124. FIG. 41 similarly shows a modified cee purlin 118B which was formed with flanges 124, 126 of equal length, and then modified to underbend the flange 124. FIG. 42 shows an eave strut 118C, a modified cee purlin 118, which was formed with flanges 124, 126 of equal length, and then modified to underbend the flange 124 and overbend the flange 126 while maintaining the lips 128, 130 parallel to the web 122. FIG. 43 represents a modified cee purlin as in FIG. 42 except that the lip 128 has been maintained as orthogonal to the flange 126 and thereby non-parallel with respect to the web 122.

In order to provide eave struts such as represented in FIGS. 40 through 43 typically requires secondary operations remote from a conventional roll forming machine. Typically, the formed purlin is transferred to a press brake where the desired modifications are made one hit at a time. The present invention, however, provides a number of retractable rollers that operate in unison with the previously described flange forming and lip forming rollers to form the eave struts.

Turning now to FIGS. 44 through 47 which show various views of an eave strut assembly 434 which receives the purlins from the distal end 108 of the convertible roll forming apparatus 100 and performs forming operations to provide eave struts as desired. It will be noted that a set of inboard idler rollers 436, 438, 440 are supported by a fixed base plate 442. An opposing set of outboard idler rollers 437, 439, 441 are supported by a laterally moveable base plate 444. The moveable base plate 444 is supported in a conventional manner by a number of liner bearings (not shown) and positioned by a lead screw 446 (see FIG. 45) connected to an adjustment handwheel 448.

Figure 45:
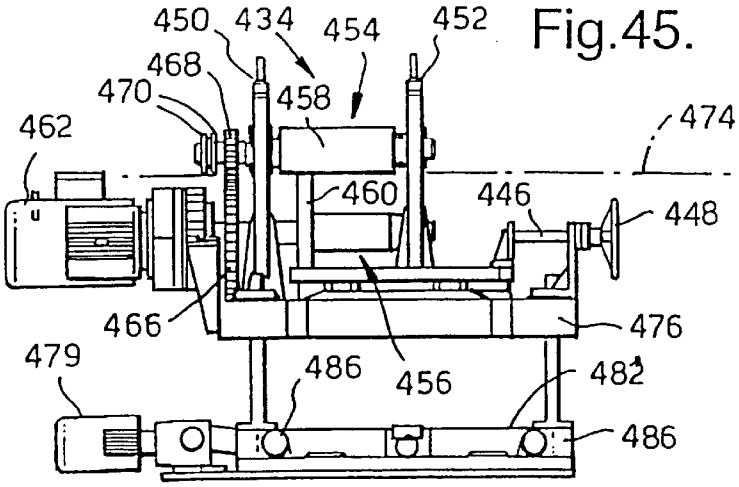
FIG. 45 is an elevational view of the eave strut assembly of FIG. 44 in the operable mode.

FIG. 45 best shows the manner in which an inboard support stand 450 and an outboard stand 452 support an upper roller assembly 454 and a lower roller assembly 456 which drive an upper roller 458 and a lower roller 460, respectively, between which the formed purlin is grippingly engaged and moved along the material feed direction previously defined.

As shown, three of the inboard support stands 450 (FIG. 44) are provided, and the central support stand 450 supports the corresponding lower roller assembly 456 in connection with a gearmotor 462. A gear 466 of the lower roller assembly 456 matingly engages a gear 468 of the upper roller assembly 454 to transfer rotational power to the driving rollers 458, 460. It will be noted that the central upper roller assembly 454 has a pair of sprockets 470 over which is trained a chain 472 (see FIG. 44) between adjacent upper roller assemblies 454 in order to drive the adjacent upper roller assemblies 454. Those adjacent upper roller assemblies 454 thereby drive the adjacent lower roller assemblies 456 by transmission of gears 466, 468.

As described, the gearmotor 462 provides power to the rollers 458, 460 to operably pass the formed purlin through the idler rollers 436 through 441 which are interposed between the roller assemblies 454, 456. In this operable mode of the eave strut assembly 434 the strip material exits the distal end 108 of the convertible roll forming apparatus 100 at an elevation designated by the horizontal pass line 474, corresponding to the contact interface between the driving rollers 458, 460. In this manner the purlins leaving the lip forming rollers of the distal end 108 enter immediately thereafter into the eave strut idler rollers when eave strut members are desired.

Figure 46:
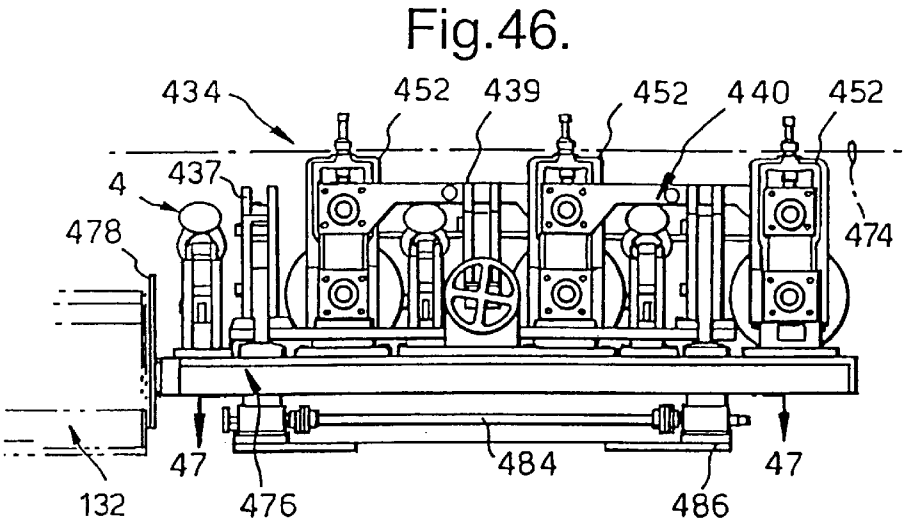
FIG. 46 is an elevational view of the eave strut assembly of FIG. 44 in the recessed mode.

At all times when regular purlins are desired, that is, when the eave strut assembly 434 is inoperable, the eave strut assembly 434 retracts vertically to allow the purlins to pass thereby without modification. FIG. 46 provides a side view of the eave strut assembly 434 in this retracted mode wherein it will be noted the exiting strip material 104 at the elevation denoted by line 474 can clearingly pass between the upstanding support stands 450, 452 and there be supported by the upper rollers 458 which, by reversing the direction of motor 462, then act as a conveyor to convey the purlins to an off-load position downstream of the eave strut assembly.

Figure 47:
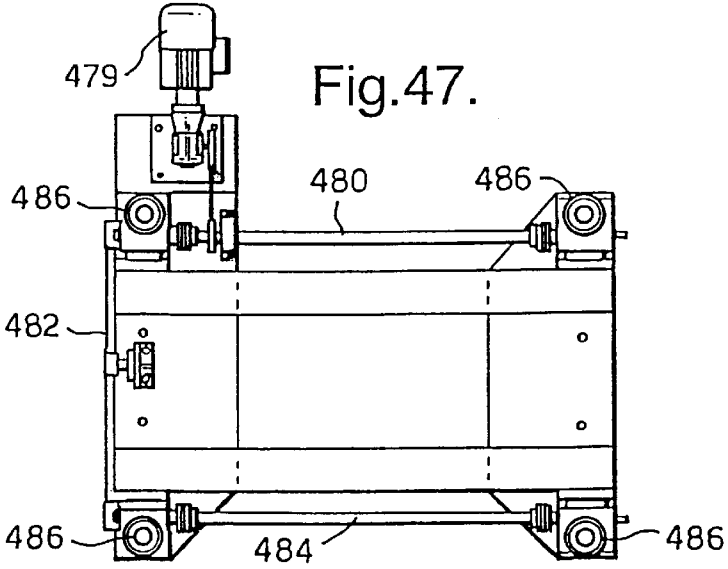
FIG. 47 is a sectional view taken generally along the line 47—47 of FIG. 46.

It will be noted that the eave strut assembly 434 is supported in vertical movement between the operable and retracted position by attaching a framework 476 of the eave strut assembly to the mill base 132 of the convertible roll forming apparatus 100 with a conventional linear bearing 478. FIG. 47 best shows a detail along the section line 47—47 of FIG. 46 of the manner in which the framework 476 is raised and lowered. A gearmotor 479 turns a first shaft 480 which, in turn, by way of chain 482 drives a parallel second shaft 484. A pair of screw jacks 486 are driven by each of the shafts 480, 484 to raise the framework 476 in a first direction of the shafts 480, 484 and to lower the framework in an opposite direction of the shafts 480, 484.

Figure 48:
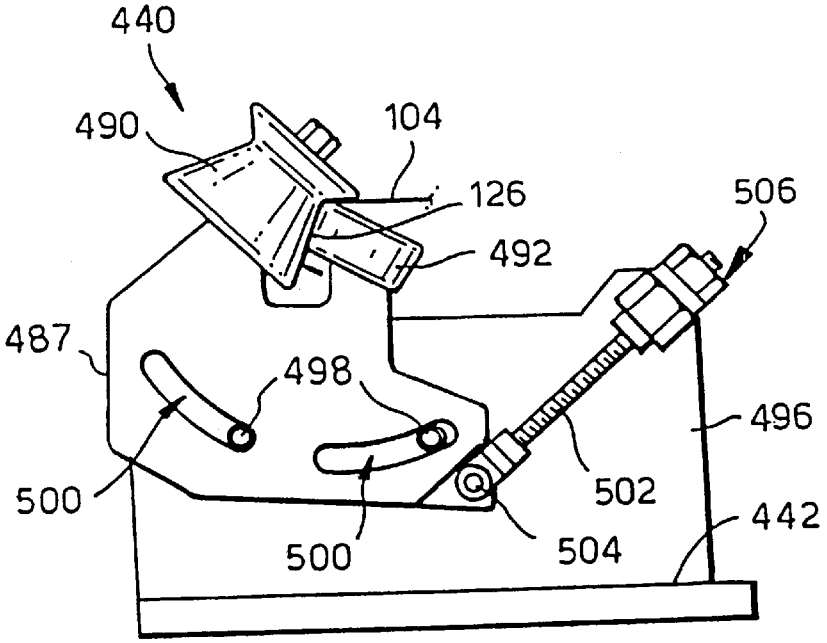
FIG. 48 is an elevational view of the last inboard eave strut idler in the eave strut assembly of FIG. 44.
Figure 49:
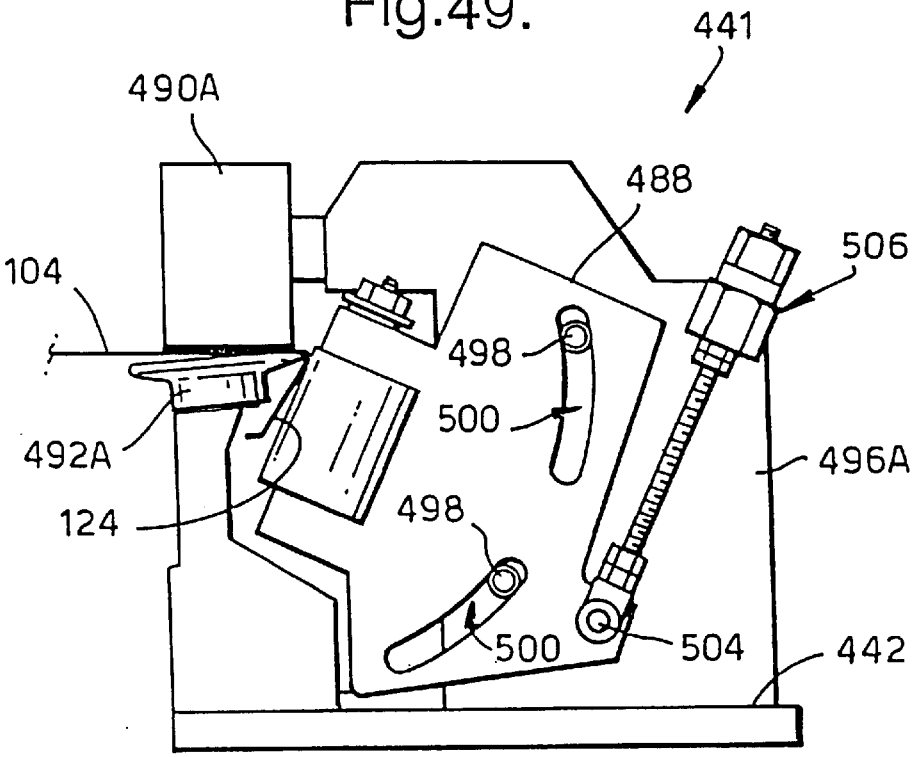
FIG. 49 is an elevational view of the last outboard eave strut idler in the eave strut assembly of FIG. 44.

FIGS. 48 and 49 show the last inboard eave strut roller 440 and the last outboard eave strut roller 441 which cooperatively form a cee purlin 118 formed by the convertible roll forming apparatus 100 into an eave strut 118C as shown in FIG. 42. The eave strut rollers 440, 441 utilize pivotally positionable idler blocks 487, 488 respectively, to position idlers rollers appropriately to provide the desired eave strut.

The eave strut roller 440, as shown in FIG. 48, has a pair of interfitting idler rollers, namely an anvil roller 490 and a press roller 492, which cooperate to unbend the flange 126 as the strip material 104 is caused to be passed therethrough. The rollers 490, 492 are mounted on the idler block 487 which is supported for limited pivotal movement between a pair of parallel plates 496 (one shown) via pins 498 that extend through arcuate slots 500 in the idler block 487. The slots 500 are located such that they generally have the central arc in the center of the male forming radius on idler 492 and thus as idler block 489 rotates through the arcuate slots the center of the forming radius is held in one place with respect to plates 496 and base 442 when an adjustment is made to nut 506. One end of the block 487 is connected to the proximal end of a threaded rod 502 at a pivot connection 504. The distal end of the rod 502 is engaged by a nut member 506 attached to the support plates 496 such as by pins or the like. Rotation of the nut member 506 determines the angular disposition of the idler block 487.

The eave strut roller 441, as shown in FIG. 49, is similar in construction to that described for the eave strut roller 440 above, and like numerals will be used accordingly to describe it. The eave strut roller 441 has a pair of interfitting idler rollers, an anvil roller 490A and a press roller 492A, which cooperate to further bend the flange 124 as the strip material 104 is caused to be passed therethrough. The rollers 490A, 492A are mounted on the idler block 488 which is supported for limited pivotal movement between a pair of parallel plates 496A (one shown) via pins 498 that extend through arcuate slots 500 in the idler block 488. The slots 500 are located such that they generally have the center of their arc in the center of the male forming radius on roll 492A and thus as the idler roll that rolls against the flange 124 and plate 488 rotate through the arcuate slots the flange 124 is formed around the forming radius of roll 492A. This is accomplished when an adjustment is made to nut 506. It should be noted that in this case, but not necessarily in all cases, the male forming roll 492A does not pivot with plate 488 nor does roll 490A pivot with plate 488 because it is fixed with respect to the base 442. One end of the block 488 is connected to the proximal end of a threaded rod 502A at a pivot connection 504. The distal end of the rod 502 is engaged by a nut member 506 attached to the support plates 496A such as by pins or the like. Rotation of the nut member 506 determines the angular disposition of the idler block 488.

The upstream inboard eave strut rollers 436, 438 and the upstream outboard eave strut rollers 437, 439 are of similar construction to that described for the eave strut rollers 440 and 441, respectively. Of course, it will be recognized that the idler blocks (like the idler blocks 487, 488) of the upstream eave strut rollers 436 and the upstream eave strut rollers 437, 439 will be provided appropriate pivotal settings and will be outfitted with appropriately disposed idler rollers so as to progressively form the desired eave strut shape from the entering purlin received from the distal end 108 of the convertible roll forming apparatus 100.

The convertible roll forming apparatus 100 of the present invention has a user interface control panel (not shown) providing the user with the ability to obtain a desired purlin shape simply by inputting the profile characteristics of the desired purlin. Particular profiles that are repeatably produced can be stored in the control memory and displayed in tabular format for selection by the operator.

Selection of a profile characteristic defines the type of purlin, whether cee, zee, or cee channel, the web length, the flange lengths and the lip lengths. The control program uses the characteristic definitions to automatically adjust five axes in order to produce the desired purlin.

Preliminarily, the sheet material feed table 102 is laterally adjusted to a position as indicated by the control program in order to locate the inboard edge of the sheet material 104 relative to the intercept point 236 of the inboard flange forming rollers. This adjustment determines the length of the formed inboard flange 126, which is the total length of the finally formed flange in addition to the finally formed lip.

Based on the lateral position of the sheet material feed table 102 and on the desired web 122 length, the control program automatically actuates the machine screws 154 to laterally position the moveable base plate 136 in order to spatially separate the pairs of tooling rollers 182, 184 and 186, 188, and hence the corresponding intercept points 236 whereat the flanges 124, 126 are formed. This lateral position of the moveable base plate 136 is the first axis controlled by the control program.

The other four axes controlled by the control program are the four independent drive assemblies for the lip forming idlers 364–375. The control program controls the motor 400B (FIG. 35) which vertically positions the first three inboard eave strut idlers 364, 366, 368 (FIG. 36) to a first position that operably engages the upper roller 408A (FIG. 36) when a zee purlin with lips is being formed, or to a second position that operably engages the lower roller 410A (FIG. 36) when a cee purlin with lips is being formed, or to a third position that clearingly recesses the rollers 408A, 410A (FIG. 36) so that neither is operably engaged if no lip is required. The operable positions of the rollers, either for a zee or a cee, is such as to provide the desired flange length and lip length.

Figure 38:
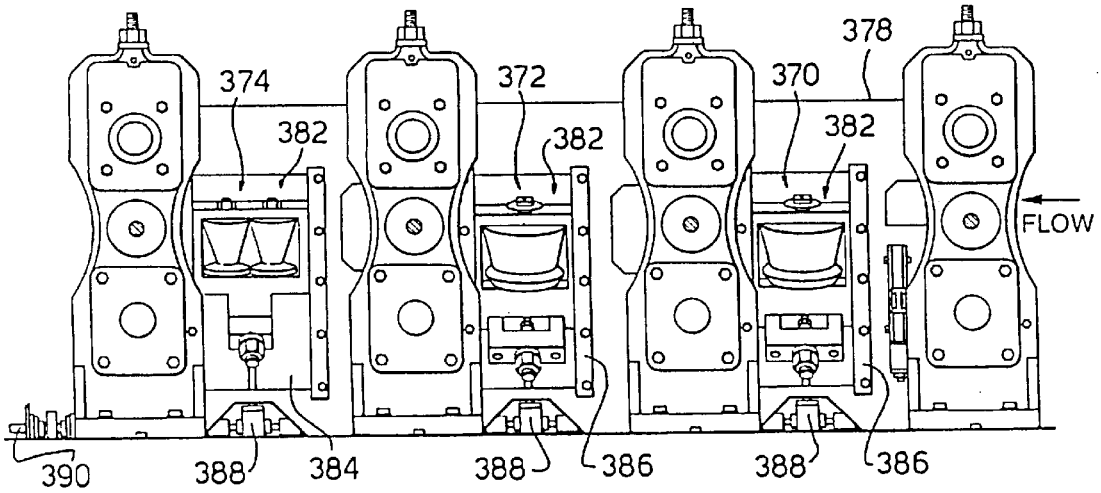
FIG. 38 is an elevational view of the last three inboard idler passes of FIG. 37.

The control program furthermore controls the motor 400C (FIG. 37) which vertically positions the last three inboard eave strut idlers 370, 372, 374 (FIG. 38). If a zee purlin is being produced the control program clearingly recesses these eave strut idlers. If a cee purlin with ninety-degree lips is being formed, however, these eave strut idlers are operably positioned to form the lips at a location so as to provide the desired flange and lip lengths.

The control program furthermore controls the motor 400 (FIG. 28) which vertically positions the first three outboard eave strut idlers 365, 367, 369 (FIG. 29). If no lips are called for, such as when a cee channel is being formed, the motor 400 (FIG. 28) clearingly recesses these eave strut idlers. If lips are required, the motor 400 positions these eave strut idlers to the appropriate position to provide the desired flange and lip length.

Finally, the control program controls the motor 400A (FIG. 30) which vertically positions the last three outboard eave strut idlers 371, 373, 375 (FIG. 31). If a zee purlin or a cee channel is being formed the motor 400A clearingly recesses these eave strut idlers. If a cee purlin with ninety degree lips is being formed the motor 400A positions these eave strut idlers to the appropriate position to form the desired flange and lip lengths.

It is to be understood that while numerous characteristics and advantages of various embodiments of the present invention have been set forth in the foregoing description, together with details of the structure and function of various embodiments of the invention, the disclosure presented herein is illustrative only, and changes may be made in details of structure and arrangement within the principles of the present invention to the full extent indicated by the broad general meaning of the terms in which the appended claims are expressed.

What is claimed is:

1. A roll forming assembly for forming an edge portion at desired angles relative to a web portion on a strip material, the assembly comprising:

a support assembly;

a first engagement assembly supported by the support assembly and moving the strip material in a feed direction; and a second engagement assembly operably engaging the strip material and in cooperation with the first engagement assembly forming the edge portion, the second engagement assembly further comprising:

a support member;

an idler supported by the support member; and a pivoting assembly for pivoting the support member to a selected one of a first position and a second position; and wherein the idler forms the edge portion to a first angle in the first position of the member and forms the edge portion to a second anole in the second position of the member, the first angle extending upwardly from the web portion and the second angle extending downwardly from the web portion, and wherein the web portion is supported in a substantially horizontal disposition.

2. The roll forming assembly of claim 1 wherein the first engagement assembly comprises a first roller assembly grippingly engaging the strip material.

3. The roll forming assembly of claim 2 wherein the first engagement assembly comprises:

an upper roller assembly, comprising:

an upper shaft journalled for rotation with the support assembly;

an upper tooling roller rotated by the upper shaft and rollingly engaging a first face of the strip material;

a lower roller assembly, comprising:

a lower shaft journalled for rotation with the support assembly; and a lower tooling roller rotated by the lower shaft and rollingly engaging a second face of the strip material.

4. A roll forming apparatus for forming an edge portion at desired angles relative to a web portion on a strip material, the apparatus comprising:

a support assembly;

a first roller assembly supported by the support assembly and moving the sheet material in a feed direction;

a positioning assembly supported by the support assembly and positionable at a selected one of a first position and a second position;

a second roller assembly supported by the positioning assembly for forming the edge portion to a first angle at the first position of the positioning assembly and for forming the edge portion to a second angle at the second position of the positioning assembly, the first angle being above the web portion and the second angle being below the web portion.

5. The roll forming apparatus of claim 4 wherein the first roller assembly comprises:

a pair of parallel shafts journaled for rotation relative to the support assembly; and a pair of tooling rollers supported by the shafts and rollingly engaging the strip material.

6. The roll forming apparatus of claim 5 wherein the positioning assembly comprises:

a support member journaled for rotation on the support assembly;

a gear supported by the support member;

a shaft having a worm portion that engages the gear to position the support member; and a motor driving the shaft.

7. A roll forming apparatus for forming an edge portion at a desired angle relative to a web portion on a strip material comprising:

a support assembly;

a first roller assembly supported by the support assembly and having opposing tooling rollers journaled for rotation on parallel axes, the tooling rollers gripping the strip material adjacent the edge portion to move the strip material in a feed direction;

a second roller assembly supported by the support assembly independently of the first roller assembly and rollingly engaging the strip material to form the edge portion to a selected one of a first angle and a second angle, the first angle being above the web portion and the second angle being below the web portion, the second roller assembly comprising:

an idler, journaled for rotation relative to the support assembly about a rotation axis non-parallel to the rotation axes of the tooling rollers, for contacting the edge portion.

8. The roll forming apparatus of claim 7 further comprising a support member depending from the support assembly and supporting the idler.

9. The roll forming apparatus of claim 8 further comprising a positioning assembly for positioning the support member relative to the support assembly to a selected one of a first position and a second position, the idler thereby forming the edge portion in the first angle in the first position and forming the edge portion in the second angle in the second position.

10. The roll forming apparatus of claim 9 wherein the positioning assembly comprises:

an engagement surface supported by a distal end of the support member;

a mating engagement surface operably engaging the engagement surface to rotate the support member between the first and second positions.

11. A roll forming apparatus through which sheet material passes in a feed direction to form an edge portion to a desired angle relative to a horizontal portion on the sheet material, comprising:

a mill base;

a stand supported by the mill base;

a tooling assembly for supporting the sheet material while the sheet material is moving in the feed direction, the tooling assembly having tooling rollers with forming surfaces defining forming radiuses, the tooling roller journaled for rotation about a first axis; and a forming assembly supported by the stand and positionable independently of the tooling assembly to form the edge portion, the forming assembly comprising an idler that urges the sheet material against a selected forming radius in forming the edge portion to a selected one of an upward or downward position, the forming assembly having a support member supported by the stand and supporting the idler for journaled rotation about a second axis nonparallel to the first axis.

12. A roll forming apparatus for forming a flange portion at desired angles relative to a web portion on a strip material comprising:

a support stand;

a first roller assembly supported by the support stand and moving the sheet material in a feed direction, the first roller assembly comprising:

a shaft journalled for rotation relative to the support stand; and a tooling roller supported by the first shaft and rollingly engaging the strip material;

a pivoting assembly supported by the support stand and pivotally positionable at a first position and at a second position, the pivoting assembly comprising a knuckle having an angled face at a proximal end and a medial portion journalled for rotation with the support stand;

a gear supported by a distal end of the knuckle;

a shaft having a worm portion that engages the gear to position the knuckle; and a motor for driving the shaft; and a second roller assembly supported by the pivoting assembly for forming the flange portion to a first angle at the first position of the pivoting assembly and for forming the flange portion to a second angle at the second position of the pivoting assembly.

13. A roll forming apparatus for forming a flange portion on a strip material comprising:

a support stand;

a first roller assembly supported by the support stand and grippingly engaging the strip material for movement thereof in a feed direction; and second roller assembly supported by the support stand independently of the first roller assembly and rollingly engaging the strip material in forming the flange portion;

wherein the first roller assembly comprises a tooling roller that contacts the strip material adjacent the flange portion, and the second roller assembly comprises an idler that contacts the flange portion, the tooling roller journalled for rotation relative to the support stand about a first axis, the idler journalled for rotation relative to the support stand about a second axis, wherein the first axis is non-parallel to the second axis;

a support member having a medial portion thereof depending from the support stand and supporting the idler at a distal end of the support member;

a pivoting assembly for pivoting the support member relative to the support stand to a first position and to a second position, the idler thereby forming the flange portion in a first angle in the support member first position and forming the flange portion in a second angle in the support member second position;

wherein the pivoting assembly comprises:

an engagement surface supported by a distal end of the support member;

a mating engagement surface operably engaging the engagement surface to rotate the support member between the first and second positions; and wherein the engagement surface comprises a worm gear and the mating engagement surface comprises a threadably engagable worm.

14. The roll forming apparatus of claim 13 wherein the worm gear comprises a hub which threadably engages the distal end of the support member.

15. The roll forming apparatus of claim 14 wherein the tooling roller is urged against the strip material by a yoke assembly, comprising:

a yoke slidably disposed within the support stand;

an adjustment rod having a distal end thereof attached to the yoke;

a threaded sleeve engaging a threaded portion of the adjustment rod to advance the adjustment rod in response to rotation thereof; and a locking nut to engage the adjustment rod at a desired position.

16. A roll forming apparatus for selectively forming a sheet material at desired angles relative to a horizontal portion on the sheet material comprising:

first and second support stands separated by a distance wherein the distance between the first and second support stands can be varied;

a plurality of shafts, each shaft supported by the first and second support stands;

a plurality of roller assemblies supported by the shafts for moving the strip material in a feed direction;

a positioning assembly positionable at a selected one of a first position and a second position; and a forming member supported by the positioning assembly for forming the sheet material to a first angle that is positive with respect to the horizontal portion at the first position of the positioning assembly and for forming the sheet material to a second angle that is negative with respect to the horizontal portion at the second position of the positioning assembly.

17. The apparatus of claim 16 wherein each of the shafts is journaled to the first support stand.

18. The apparatus of claim 17 wherein each of the shafts is slidably received by the second support stand.

19. The apparatus of claim 18 wherein the positioning assembly is supported by a selected one of the first and second support stands.

20. The apparatus of claim 19 wherein the second support stand is movable with respect to the first support stand and wherein the second support stand slidably receives the plurality of shafts.

21. The apparatus of claim 20 further comprising a second forming member supported by the second support stand for forming the sheet material to an angle with respect to the horizontal portion.

22. The apparatus of claim 21 wherein the second forming member forms the sheet material to an angle that is downward with respect to the horizontal portion.

23. The apparatus of claim 21 wherein the second forming member forms the sheet material to an angle that is upward with respect to the horizontal portion.

* * * * *

UNITED STATES PATENT AND TRADEMARK OFFICE

CERTIFICATE OF CORRECTION

PATENT NO. : 6,148,654 
DATED : November 21, 2000
INVENTOR(S) : Gary L. Jensen, Robert G. McLellan and Terrance L. Jud It is certified that error appears in the above-identified patent and that said Letters Patent is hereby corrected as shown below:

Column 11,
Line 28, replace "female idler which" with -- female idler 248 which --.
Line 47, replace "for upwordly bending" with -- for upwardly bending --.

Column 19,
Line 49, replace "a second anole" with -- a second angle --.

Column 22,
Line 22, replace "a hub which threadably engages" with -- a hub which engages --.

Signed and Sealed this

Sixteenth Day of July, 2002

*Attest:*

*Attesting Officer*

JAMES E. ROGAN
*Director of the United States Patent and Trademark Office*